US005635904A

United States Patent [19]

Takahashi et al.

[11] Patent Number: 5,635,904

[45] Date of Patent: Jun. 3, 1997

[54] FIRE ALARM SYSTEM

[75] Inventors: Keiichi Takahashi; Atsushi Ohkawara, both of Tokyo, Japan

[73] Assignee: Nohmi Bosai Ltd., Tokyo, Japan

[21] Appl. No.: 324,678

[22] Filed: Oct. 18, 1994

[30] Foreign Application Priority Data

Oct. 26, 1993 [JP] Japan ..... 5-290023

[51] Int. Cl.[6] ..... G08B 29/00

[52] U.S. Cl. ..... 340/506; 340/505; 340/524; 340/525; 340/825.06; 340/825.08

[58] Field of Search ..... 340/505, 506, 340/825.06, 825.07, 825.08, 828.16, 825.2, 825.21, 825.54, 524, 525, 825.17, 825.18, 825.52

[56] References Cited

U.S. PATENT DOCUMENTS 4,996,518 2/1991 Takahashi et al. ..... 340/506

5,017,905 5/1991 Yuchi ..... 340/506

5,227,776 7/1993 Starefoss ..... 3430/825.36

5,493,271 2/1996 Kobayashi et al. ..... 340/505

*Primary Examiner*—Jeffery Hofsass

*Assistant Examiner*—Daryl C. Pope

*Attorney, Agent, or Firm*—Wenderoth, Lind & Ponack

[57] ABSTRACT

A fire alarm system having terminal units in a supervisory system for supervising a fire phenomenon, a receiving portion and terminal units in a control system to be controlled by the receiving portion that is able to reduce a required space in a case of a small size system. The terminal units in the supervisory system are given individual addresses, the terminal units in the supervisory system and the receiving portion communicate with each other through the addresses, and the terminal units in the control system are connected to the receiving portion through individual signal lines.

12 Claims, 32 Drawing Sheets

FIRE ALARM SYSTEM

BACKGROUND OF THE INVENTION

1. Field of the Invention

This invention relates to a fire alarm system in which terminal units, such as fire detectors and smoke blocking and exhausting units, are connected to a receiver thereof.

2. Description of the Related Art

As a conventional fire alarm system, a P-connection fire alarm system has been known in which a multiplicity terminal units are connected to a receiver thereof in such a manner that each terminal unit is enabled to communicate with the receiver by an individual signal. However, the foregoing conventional fire alarm system cannot preferably be adapted to a large size system because the number of signal lines increases in proportion to the number of the terminal units.

Accordingly, an R-connection fire alarm system has been suggested in which an individual address is given to each terminal unit and thus the receiver is allowed to communicate with each terminal unit through the address. As a result, the number of the signal lines can be decreased significantly.

However, the R-connection fire alarm system must comprise a relay in a case where units to be controlled, such as smoke blocking and exhausting units, are disposed, in order to decode commands issued from the receiver and instruct the unit to be operated. In a small size fire alarm system in which a large number of terminal units are not disposed, there arises a problem in that a space for disposing the relay cannot be provided because the space given to the fire alarm system is not sufficiently large.

SUMMARY OF THE INVENTION

An object of the present invention is to provide a fire alarm system having terminal units in a supervisory system for supervising a fire phenomenon, a receiving portion and terminal units in a control system to be controlled by the receiving portion and capable of reducing the required space if a small-size fire alarm system is intended to be constituted.

According to one aspect of the present invention, there is provided a fire alarm system in which terminal units in a supervisory system are given individual addresses, the terminal units in the supervisory system and a receiving portion communicate with each other through the addresses, and terminal units in a control system are connected to the receiving portion through individual signal lines.

Since the terminal units in the supervisory system are given individual addresses, the terminal units in the supervisory system and the receiving portion communicate with each other through the addresses, and the terminal units in the control system are connected to the receiving portion through the individual signal lines, the required space can be reduced in case where a small size fire alarm system is intended to be constituted.

DESCRIPTION OF THE PREFERRED EMBODIMENTS

Figure 1:
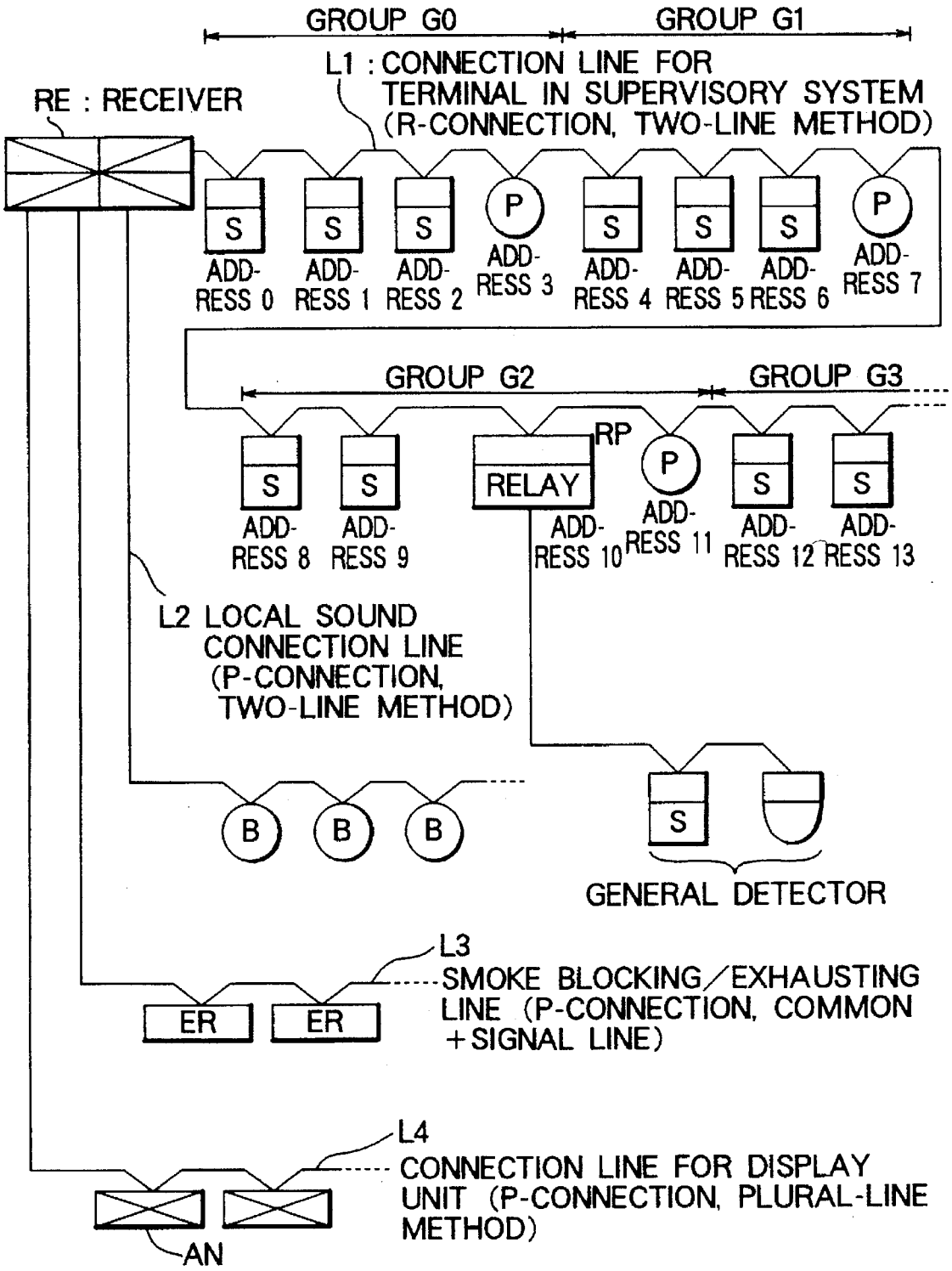
FIG. 1 is a diagram of a circuit for use in a fire alarm system according to an embodiment of the present invention.

FIG. 1 is a diagram of a circuit for use in a fire alarm system according to a first embodiment of the present invention.

In the fire alarm system, a variety of terminal units, such as (smoke type, heat type, flame type, gas type, smell type or the like) fire detectors S, transmitters P and relays RP, are connected to a fire receiver RE through terminal unit connection lines L1 in a supervisory system, the terminal units having individual addresses and being divided into four groups G0, G1, G2 and G3.

The group G0 includes three fire detectors S and one transmitter P, the group G1 includes three fire detectors S and one transmitter P, group G2 includes two fire detectors S, one relay RP and one transmitter P, and group G3 includes three fire detectors S and one transmitter P. The terminal units have corresponding addresses 0 to 15 such that the terminal unit in the group G0 has address 0, the address being increased sequentially. A plurality of general detectors (each having no address) of an on/off type that transmit a fire signal when circuits thereof are short-circuited are connected to the relay PR having address 10. Although four terminal units are included in one group in the foregoing example, the number of the terminal units is not limited to four. Also the number of the groups is not limited to four.

To the receiver RE, a plurality of local bells B are connected through local sound connection lines L2, a plurality of smoke blocking and exhausting units ER are connected through smoke blocking and exhausting lines L3, and a plurality of display units AN are connected through display unit connection lines L4.

In the foregoing embodiment, the local bells B, the smoke blocking and exhausting units ER and the display units AN in a controlled system are not given the address but are controlled by connecting/disconnecting the lines L2 to L4 provided for the corresponding terminal units or the systems. That is, the controlled terminal units, such as the local bells B, the smoke blocking and exhausting units ER and the display units AN, are respectively or in each system, connected in a so-called P-connection manner. The address of each of the fire detectors S, the transmitters P and the relays RP in a supervisory system is appointed by serial transmission or the like through two common signal lines L1 also serving as power sources so as to be controlled individually. That is, the terminal units in the supervisory system, such as the fire detectors S, the transmitters P and the relays RP are connected in a so-called R-connection manner.

Figure 2:
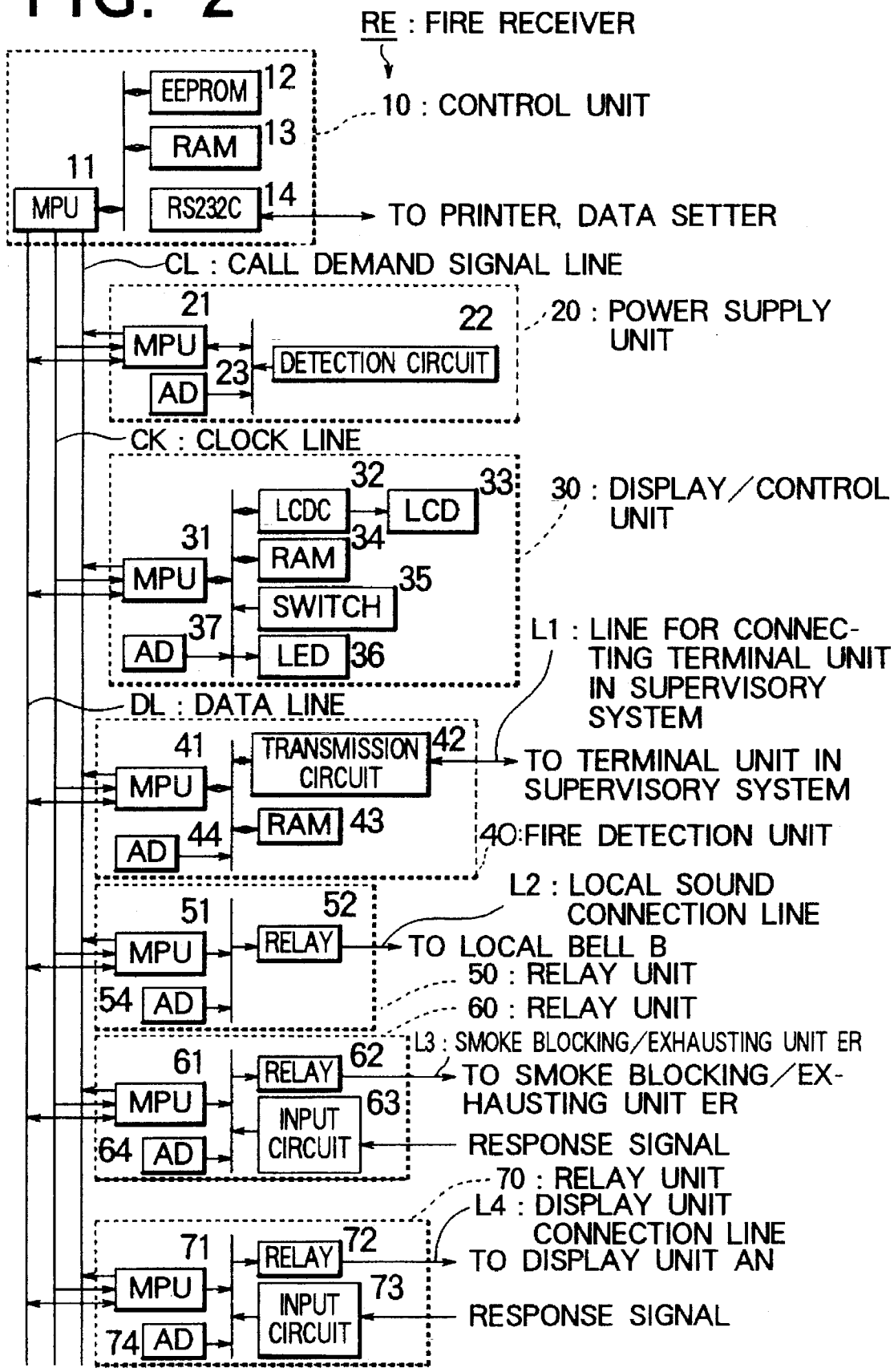
FIG. 2 is a block diagram showing a fire receiver RE according to the foregoing embodiment.

FIG. 2 is a block diagram showing the fire receiver RE according to the foregoing embodiment.

The fire receiver RE comprises control unit 10, a power supply unit 20, a display/control unit 30, fire detection unit 40 and relay units 50, 60 and 70 that control the respective units to be controlled. A data line DL, a clock line CK and a call demand signal line (a service require signal line) CL are connected among the relay units 10, 20, 30, 40, 50, 60 and 70. The relay units 20 to 70 have individual addresses.

The control unit 10 is a unit for controlling, through the data line DL, the power supply unit 20, the display/control unit 30, the fire detection unit 40 and the relay units 50, 60 and 70. The control unit 10 performs a polling operation through the data line DL to confirm the normal operation of each unit and to transmit information among the units by sequentially and circularly calling the units 20, 30, 40, 50, 60 and 70. The calling operation is performed through the data line DL in such a manner that calling of a unit and collecting of status information of the unit have been completed and then calling of a next unit and collecting of status information of the unit are commenced.

The control unit 10 comprises an MPU (a microprocessor) 11, an EEPROM 12, a RAM 13 and a port 14 for RS232C.

The power supply unit 20 comprises: an MPU (a microprocessor) 21 for performing communication with the control unit 10 and for supervising and controlling the total operation of the power supply unit 20; a detection circuit 22 for detecting whether or not a main power supply unit and a sub-power supply unit (not shown) are in a normal state; and an address setting portion 23.

The display/control unit 30 comprises: an MPU (a microprocessor) 31 for performing communication with the control unit 10 and for controlling the total operation of the display/control unit 30; an LCD (Liquid Crystal Device) 33 for displaying, for example, a fire block or the like; an LCD control circuit 32 for controlling the LCD 33; a RAM 34, switches 35 for controlling the fire restration, controlling the operation of individual terminal units and performing tests; an LED 36 for indicating states of the switching operations and the supervised states; and an address setting portion 37.

The fire detection unit 40 comprises: an MPU (a microprocessor) 41 for performing communication with the control unit 10 and for controlling the total operation of the fire detection unit 40; a transmission circuit 42 for performing communication when the polling operation with the terminal unit, such as the fire detector or the transmitter, is performed; a RAM 43; and an address setting portion 44.

The relay units 50, 60 and 70 comprise: MPUs (microprocessors) 51, 61 and 71 for performing communication with the control unit 10 and for controlling the relay units 50, 60 and 70; relays 52, 62 and 72 for controlling the controlled units; input circuits 53, 63 and 73 for receiving response signals representing the operations and transmitted by the controlled units; and address setting portions 54, 64 and 74. Although the relay units 50, 60 and 70 are arranged to control the local sound, the smoke blocking and exhausting units and the fire display units, they may control other units.

The units 10, 20, 30, 40, 50, 60 and 70 are connected mutually through the call demand signal lines CL. When a unit except the control unit 10 has transmitted to the control unit 10 a call demand signal through the call demand signal lines CL, signals each representing whether or not the demanded signal has been transmitted are collected from the respective units through the data lines DL.

The call demand signal is transmitted to the control unit 10 from a unit except the control unit 10 in order to cause the control unit 10 to call a unit. The MPUs 11, 21, 31, 41, 51, 61 and 71 for controlling the corresponding units are operated in accordance with an included program. The address setting portions 23, 37, 44, 54, 64 and 74 are given individual addresses by using a storage means that cannot be erased, for example, a dip switch or an EEPROM.

Figure 3:
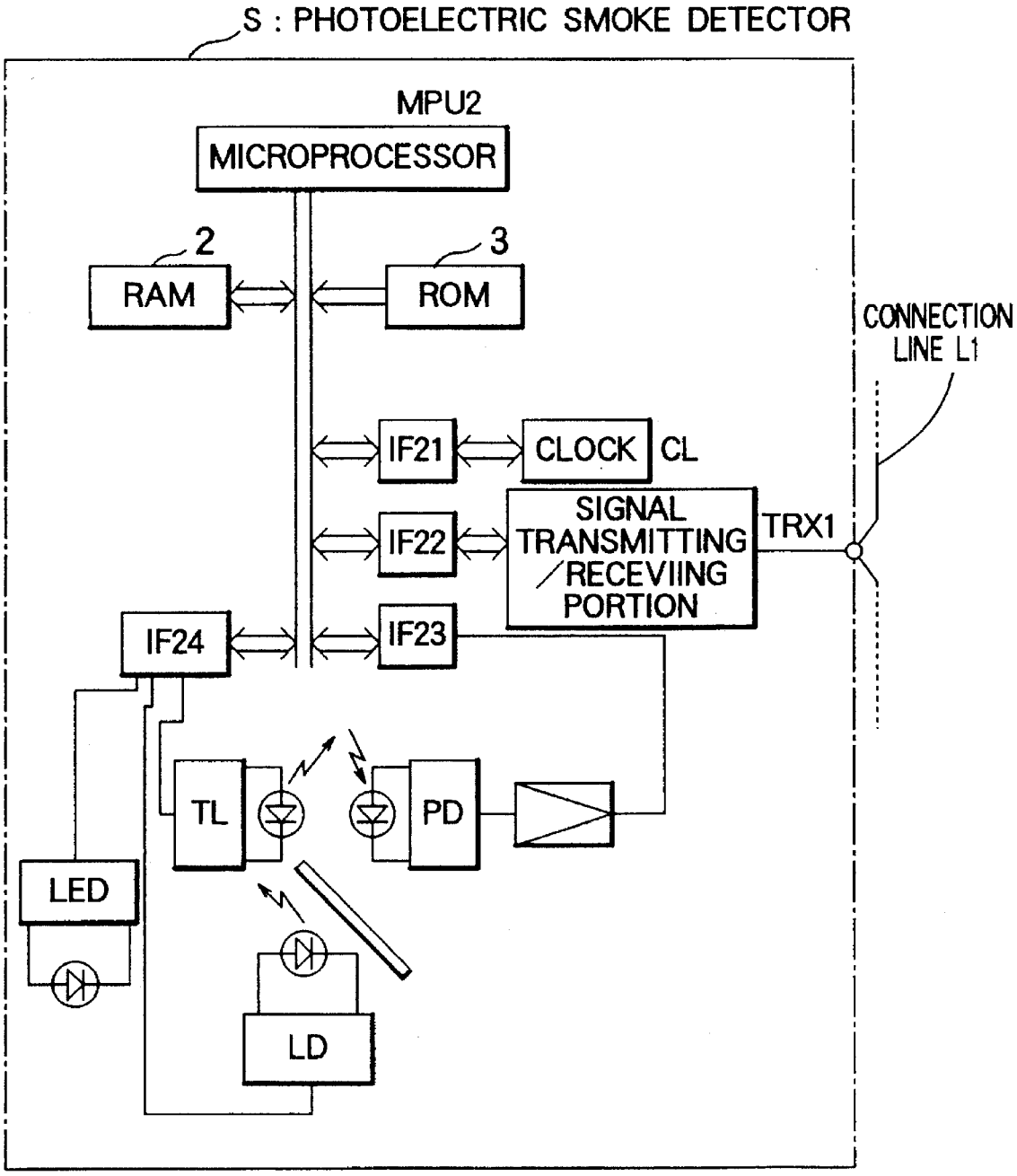
FIG. 3 is a block diagram showing a photoelectric smoke detector S according to the foregoing embodiment.

FIG. 3 is a block diagram showing the photoelectric smoke detector S according to the foregoing embodiment.

The photoelectric smoke detector S comprises a microprocessor MPU 2, a RAM 2, a ROM 3, interfaces IF 21 to IF 24, a signal transmitting/receiving portion TRX 1, a clock generation source CL, a light emitting diode LD for detecting smoke, a photodiode PD, a test lamp TL and a light emitting diode LED serving as an operation confirming lamp.

The RAM 2 is a region for storing present status information of the detector S, status information transmitted to the fire detection unit 40 of the fire receiver RE, a variety of flags, group number g of the terminal unit that is required to perform transmission, the number m in the group and address n for the transmission, the RAM 2 also serving as a working region.

The ROM 3 is a region for storing a program for controlling the operation of the photoelectric smoke detector S, the self-address terminal number and the type ID of each terminal unit, and various references for discriminating a fire and a breakdown. The self-address terminal number of the terminal unit and so forth may be stored in the dip switch or the like, if necessary. The various discrimination references and the like may be stored in the EEPROM. The signal transmitting/receiving portion TRX 1 has a similar structure and operation to those of the transmission circuit 42.

Figure 4:
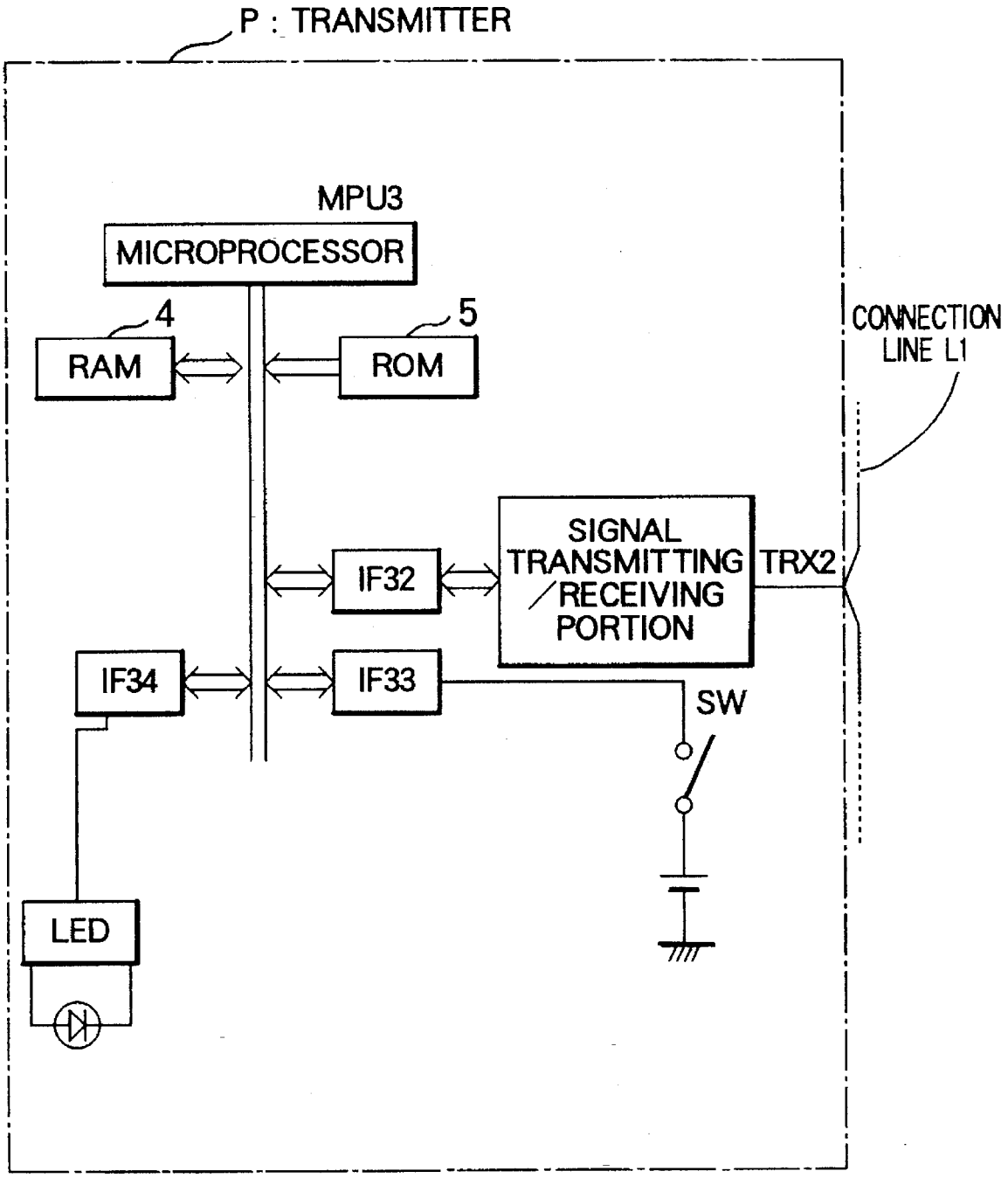
FIG. 4 Is a block diagram showing a transmitter P according to the foregoing embodiment.

FIG. 4 is a block diagram showing the transmitter P according to the foregoing embodiment.

The transmitter P comprises a microprocessor MPU 3, a RAM 4, a ROM 5, interfaces IF 32 to IF 34, a signal transmitting/receiving portion TRX 2, a push-button-type switch SW to be depressed when a fire has been broken out, and a light emitting diode LED serving as s response lamp.

The RAM 4 is a region for storing the present status information of the transmitter P, status information, a variety of flags, group number g of the terminal unit that is required to perform transmission, the number m in the group and address n for the transmission that have been transmitted to the fire detection unit 40 of the receiver RE, the RAM 4 also serving as a working region.

The ROM 5 is a region for storing a program for controlling the transmitter P, the self-address of the transmitter P and the type. The self-address and the type may be stored in the dip switch or the like. The signal transmitting/receiving portion TRX 2 has a similar structure and operation as those of the transmission circuit 42.

The operation of this embodiment will now be described.

Figure 5:
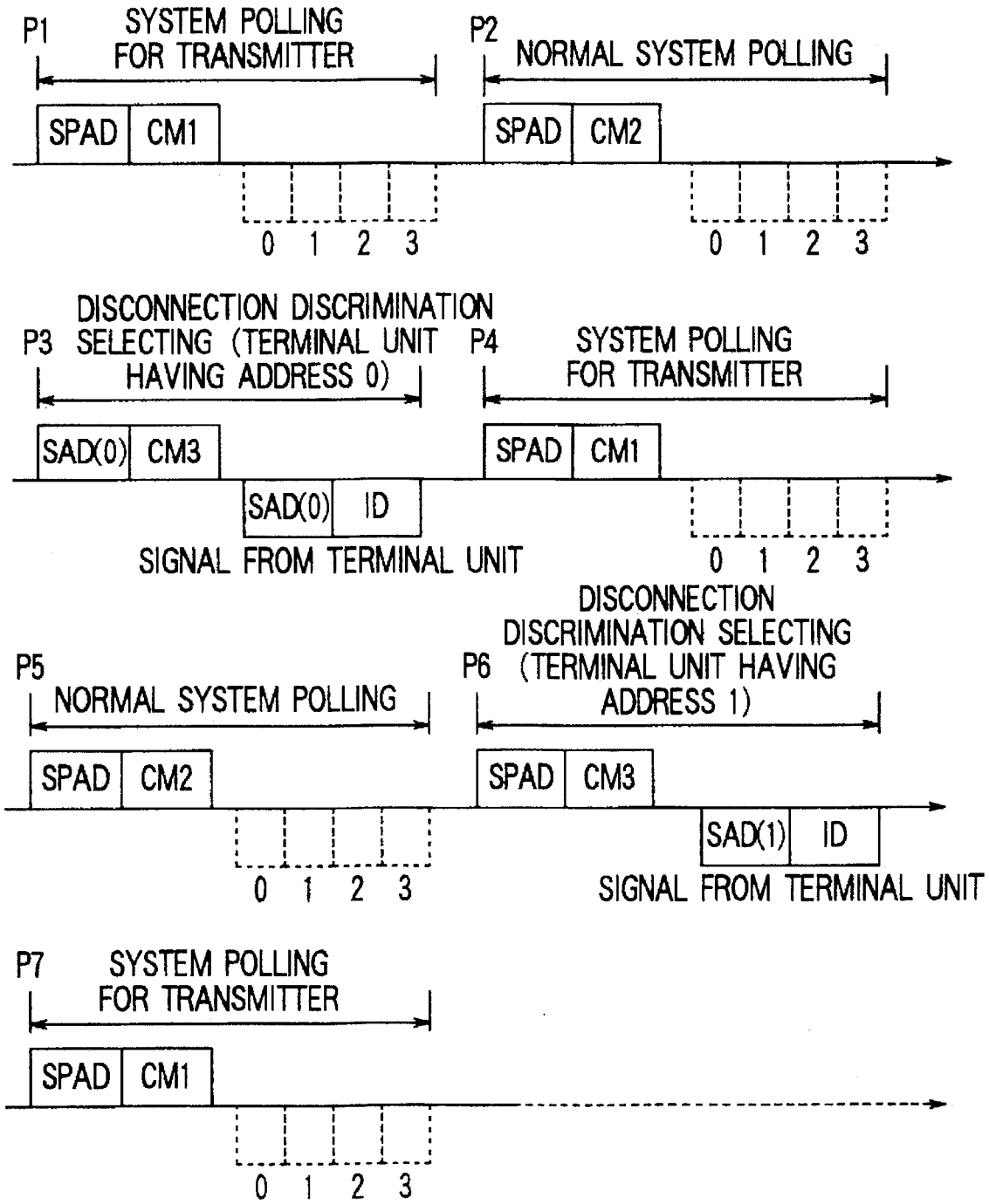
FIG. 5 is a time chart of the operation to be performed in a case where a transmitter P having a status change is not present (that is, a time chart for a normal operation)

FIG. 5 is a time chart for detecting a fire by the system according to this embodiment.

Prior to describing the time chart shown in FIG. 5, the basic operation of the receiver RE will now be described.

The receiver RE performs normal system polling, normal point polling, selecting, system polling for a transmitter, point polling for a transmitter and selecting in such a manner that the receiver RE performs the system polling for a transmitter, point polling for a transmitter and selecting before it performs the normal system polling, normal point polling and the selecting.

The "normal system polling" is polling in which the terminal units are previously divided into a plurality of groups and a terminal unit having a status change is not specified but only whether or not a terminal unit having a status change is present is examined for each group. That is, the terminal unit groups have individual timings at which the group responds to the fire detection unit 40 of the receiver RE and a terminal unit having a status change responds to the fire detection unit 40 of the receiver RE (for example, by transmitting pulses) at the timing assigned to a group including the terminal unit that has the status change.

The "normal point polling" is polling for specifying a terminal unit that has responded to the normal system polling (that is, polling for specifying a terminal unit having a status change). In this polling, the fire detection unit 40 of the fire receiver RE calls a terminal unit belonging to the group that has responded to the fire detection unit 40 of the fire receiver RE in the normal system polling; the timings at which the respective terminal units in the foregoing group respond to the fire detection unit 40 of the fire receiver RE are made to be different from one another (for example, the responding timings are made to be different from one another by transmitting pulses), and the terminal unit having the status change responds to the fire detection unit 40 (for example, by transmitting pulses) at the responding timing assigned to the terminal unit having the status change.

The "selecting" in the normal point polling is polling to be performed in a case where a terminal unit has responded to fire detection unit 40 of the fire receiver RE in the normal point polling, the selecting being performed in such a manner that the fire detection unit 40 of the fire receiver RE calls a terminal unit of the terminal units in the subject group that has responded in the normal point polling and the fire detection unit 40 of the fire receiver RE collects specific information (for example, in the form of a code signal).

The "system polling for a transmitter" is polling in which only transmitters among the terminal units are previously divided into a plurality of groups, a transmitter having a status change is not specified, but only whether or not a transmitter having a status change is present is examined for each group. That is, the transmitter groups have individual timings at which they respond to the fire detection unit 40 of the fire receiver RE, and a transmitter having a status change responds to the fire detection unit 40 of the fire receiver RE at the timing assigned to the group to which the transmitter having the status change belongs (for example, by transmitting pulses).

The "point polling for a transmitter" is polling for specifying a transmitter that has responded to the system polling for a transmitter. A transmitter belonging to a group that has responded to the fire detection unit 40 of the fire receiver RE in the system polling for a transmitter is called, the transmitters in the group have different timings at which they respond to the fire detection unit 40 of the fire receiver RE, and the transmitter having a status change responds to the fire detection unit 40 of the fire receiver RE at the responding timing assigned to the transmitter (for example, by transmitting pulses).

The "selecting" in the point polling for a transmitter is polling to be performed in a case where a transmitter P has responded to the fire detection unit 40 of the fire receiver RE in the point polling for a transmitter, the selecting being performed in such a manner that the transmitter P among transmitters P in the subject group that has responded to the fire detection unit 40 of the fire receiver RE in the point polling for a transmitter is called and the fire detection unit 40 of the fire receiver RE collects specific information (for example, in the form of a code signal).

If the receiver RE has sequentially called a plurality of terminal units, demanded them to transmit specific information and received the specific information from the subject terminal unit, a discrimination is made that no disconnection has taken place between the receiver RE and the subject terminal unit. If type information is used as the specific information, the receiver RE collates type information supplied from the terminal unit and received by the receiver RE and type information of the subject terminal unit registered in the receiver RE. If the two types of information do not coincide with each other, a discrimination is made that the type of the terminal unit has been changed.

In the time chart shown in FIGS. 5 and 6, the operation proceeds from the upper left portion toward the upper right portion, and then the operation proceeds from the foregoing right end to the left end below the foregoing step. The operation proceeds sequentially in the foregoing manner.

Figure 6:
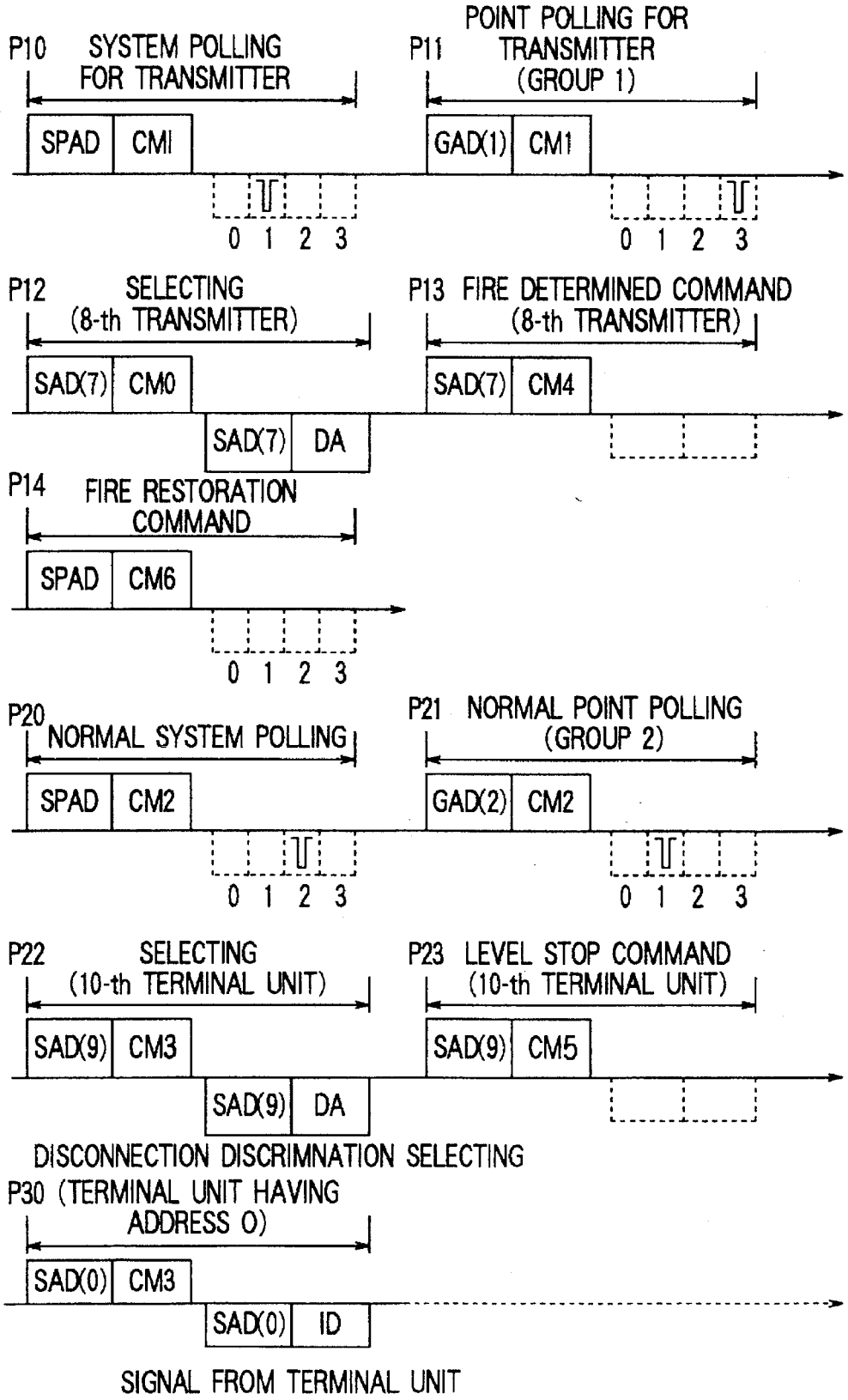
FIG. 6 is a time chart of the operation to be performed in a case where a transmitter P having a status change is present and also a terminal unit except the transmitter P has a status change.

Referring to FIGS. 5 and 6, the operation of the fire detection unit 40 of the fire receiver RE is shown above a horizontal line and the operation of the transmitter P or a terminal unit except the transmitter P is shown below the horizontal line. Also referring to FIGS. 5 and 6, dashed-line columns show responding timings of a signal denoting generation of status change, omission of description in the dashed-line columns shows a fact that a signal denoting a status change was not transmitted from the transmitter P or a terminal unit except the transmitter P (that is, no response to the polling was made), pulse waveforms in the dashed-line columns show responses made to the fire detection unit 40 of the fire receiver RE at the timings shown in the dashed-line columns, and continuous-line columns below the horizontal lines show signals returned from a transmitter P or the like to the fire detection unit 40 of the fire receiver RE.

The time chart shown in FIG. 5 will now be described.

FIG. 5 is a time chart in a case where a transmitter P or the like having a status change is not present (that is, it is a time chart in a normal state).

At P1 shown in FIG. 5, the system polling for a transmitter is performed prior to performing the normal system polling for determining whether or not there is a transmitter P that has been operated. That is, all terminal units are divided into groups (four in the structure shown in FIG. 5). The fire detection unit 40 of the fire receiver RE transmits signal SPAD·CM1 denoting a status information return command in the system polling for a transmitter. Upon receipt of the signal SPAD·CM1, the transmitter (operated transmitter) P having the status change responds to this by transmitting a pulse denoting the status change at the responding timing for any of the groups G0 to G3 (individual responding timing is previously given to each group) to which the transmitter P belongs.

If there is no transmitter P having a status change in the system polling for a transmitter, the normal system polling is performed at P2 shown in FIG. 5 in order to determine whether or not a status change has undergone with any of all terminal units including the transmitter P. That is, the fire detection unit 40 of the fire receiver RE transmits code SPAD·CM2 denoting status information return command in the normal system polling. Upon receipt of the code SPAD·CM2, if a terminal unit is present that has a status change, the terminal unit responds to this by transmitting a pulse denoting the status change to the fire detection unit 40 of the fire receiver RE at the responding timing assigned to any of the groups G0 to G3 (individual responding timings have been previously given to the groups) to which the terminal unit belongs.

If there is no terminal unit having a status change in the normal system polling, a terminal unit having address 0 is subjected to disconnection discrimination selecting at P3 shown in FIG. 5. That is, whether or not the terminal unit having address 0 has encountered (that is, whether or not the connection has been established) disconnection by transmitting code SAD(n)·CM3 (n is a number denoting the address and is zero in this case) denoting a type information return command. If the terminal unit having address 0 returns to the fire detection unit 40 of the fire receiver RE code SAD(n)·ID (ID is the type and n is zero) denoting the self-address and the type of the fire detector upon receipt of the code SAD(n)·CM3, the receiver RE is able to confirm that no disconnection with the terminal unit having address 0 has taken place.

Then, the system polling for a transmitter, which is the same as the system polling for a transmitter at P1 is again performed at P4 shown in FIG. 5. At P5 shown in FIG. 5, the normal system polling, which is the same as the normal system polling at P2, is again performed. At P6 shown in FIG. 5, a terminal unit having the next address 1 is subjected to the disconnection discrimination selecting similar to that performed at P3. At P7 shown in FIG. 5, the system polling for a transmitter similar to that at P1 is performed. The foregoing operations are repeated. That is, the system polling for a transmitter and the normal system polling are repeated and the next terminal unit having the address increased by one is subjected to the disconnection discrimination selecting whenever one cycle of the foregoing system polling operations is completed.

Since the system polling for a transmitter is, in this embodiment, always performed prior to performing the normal system polling even if a long time takes to complete the normal system polling and the ensuing normal point polling and the selecting, the receiver RE is able to quickly detect fire information transmitted from the transmitter P if the transmitter P, which is operated depending upon the judgment made by a person, is operated. Therefore, the greater the size of the fire alarm system is, the further satisfactory effect can be obtained.

In the foregoing embodiment, the fire alarm system, which comprises the terminal units in the supervisory system for supervising a fire phenomenon, the receiver and the terminal units in the controlled system to be controlled by the receiver, has the arrangement that the terminal units in the supervisory system have individual addresses, the terminal units in the supervisory system and the receiver communicate with each other (R-connected) by serial transmission through the addresses, and the terminal units in the controlled system are connected (P-connected) to the receiver so as to be turned on/off through individual signal lines.

That is, all local bells B are connected to the two local sound connection lines L2 so as to be collectively turned on/off. The smoke blocking and exhausting connection line L3 comprises a common line and individual signal lines connected to corresponding smoke blocking and exhausting units ER, that is, comprises (the number of smoke blocking and exhausting units ER+1) signal lines. Each smoke blocking and exhausting unit ER is individually turned on/off. The display unit connection line L4 comprises a plurality of signal lines determined to be adaptable to the contents to be displayed. All display units AN are connected among the foregoing signal lines. When a predetermined signal line is turned on/off, a common content is displayed on each display unit AN. The connection line L1 for the terminal unit in the supervisory system comprises two signal lines. All fire detectors S and transmitters P are connected between two signal lines in such a manner that the units have individual addresses. By transmitting/receiving signals with given addresses, information is individually transmitted/received. Although the foregoing embodiment employs a method in which the local bells B are simultaneously rung, a method may be employed in which the local bells B are individually controlled like the smoke blocking and exhausting connection lines L3 so as to be rung simultaneously.

Since the terminal units in the supervisory system are R-connected and the terminal units in the control system are P-connected, the R-lines connected to the terminal units in the supervisory system can be minimized to two. Thus, the wiring space can be reduced. In a case of small-size fire alarm system comprising a small number of terminal units in the control system, the number of P-lines connected to the terminal units in the control system can be decreased. Therefore, the wiring space can be reduced. Although a relay must be disposed in a case where the terminal units in the control system are R-connected, the P-connection of the terminal units in the control system enables the relay to be omitted. As a result, the space required for the relay can be used effectively and the fire supervisory can be performed quickly because the supervisory system and the control system use individual lines. Furthermore, a process for transmitting command codes and so forth can be performed easily and the load that must be borne by the receiver RE can be reduced. Therefore, the discrimination can easily be made.

As the terminal unit in the supervisory system, at least any of the fire detector, the relay and the transmitter is required to be connected. As the terminal unit in the control system, at least any of the local sound unit, a fire block door, a smoke blocking damper and the display unit is required to be connected.

A time chart shown in FIG. 6 will now be described.

The time chart shows the operation according to this embodiment to be performed if a transmitter P having a status change is present and also a terminal unit except the transmitter P has a status change.

At P10 shown in FIG. 6, the system polling for a transmitter is performed and a response of any one of transmitters P belonging to the group G1 (the status change of the transmitter P) is indicated because a pulse is returned from the transmitter P at the second timing. At P11 shown in FIG. 6, the group G1 is subjected to the point polling for a transmitter. That is, the fire detection unit 40 of the fire receiver RE transmits to a terminal unit code GAD(g)·CM1 1 (g is a number denoting the group that is 1 in this case) denoting the point polling for a transmitter for discriminating the transmitter P which belongs to the group G1 and which has made a response. Since a pulse is, at the fourth timing for the group G1, returned from the transmitter P in the group G1 in response to the foregoing polling, it means that the transmitter P (the eighth transmitter P) having address 7 which is the fourth address of the four transmitters P belonging to the group G1 has made the response. At P12, the fire detection unit 40 of the fire receiver RE subjects the transmitter P having the address 7 to the selecting and requires data.

That is, the fire detection unit 40 of the fire receiver RE transmits code SAD(n)·CM0 (n is a number denoting the address which is 7 in this case) denoting a status information return command to be issued to the terminal unit having the address 7. Upon receipt of the code SAD(n)·CM0, the transmitter P having the address 7 transmits to the fire detection unit 40 of the fire receiver RE signal SAD(n)·DA (DA is data required to be transmitted which is a fire signal set as the data in this case and n is 7) denoting the self-address and data required to be transmitted.

At P13 shown in FIG. 6, the fire detection unit 40 of the fire receiver RE transmits to the eighth transmitter P code SAD(n)·CM4 (n is a number denoting the address which is 7 in this case) denoting a fire determined command in accordance with the received data DA. Thus, the eighth transmitter P turns on a response lamp and the alarm issue from the eighth transmitter P can assuredly be displayed.

The "fire determined command" is a "command for inhibiting the terminal unit among the terminal units, the operation of which has been determined, to respond to the fire detection unit 40 of the fire receiver RE". If the fire detection unit 40 of the fire receiver RE has discriminated that the terminal unit has detected a fire in accordance with the status information collected by the fire detection unit 40 of the fire receiver RE from the terminal unit by the selecting and an alarm process such as display of a fire block or the like has been performed (that is, if a fire of the terminal unit has been determined), the fire determined state for the terminal unit is not suspended until a fire restoring operation is performed. If the terminal unit continues response to the system polling or the point polling after the fire has been determined, the fire detection unit 40 of the fire receiver RE performs meaningless processes for the terminal unit though the fire determination is maintained. The meaningless processes delay the polling operation and the selecting operation for the other terminal units, the operation of which has not been determined.

The fire detection unit 40 of the fire receiver RE, by selecting, transmits to the terminal unit that has been determined to be caught in a fire (that is, the terminal unit, the operation of which has been determined) the fire determined command so that the ensuing response of the terminal unit to the system polling and the point polling is inhibited. Although the foregoing description has been made about the case where a fire has been determined, a structure may be employed in which the response to the system polling and the point polling is inhibited in accordance with the fire determined command in also a case where the operation of the terminal unit has been determined due to breakdown of the fire detector (for example, impossible for its light emitting device to emit light) or disconnection of, for example, a secondary electricity passage of the relay.

In a case of the transmitter P, if its button is depressed, the fire detection unit 40 of the fire receiver RE displays the fire block or the address to issue an alarm. Thus, the operation of the transmitter P is determined.

Therefore, the eighth transmitter P that has received the fire determined command SAD(7)·CM4 from the fire detection unit 40 of the fire receiver RE stops response to the ensuing system polling and point polling. When the fire detection unit 40 of the fire receiver RE transmits fire restoring command SPAD·CM6 at P14 at the time of restoring the system after the process against the fire has been completed, the transmitter P that has received the fire determined command as described above is restored in response to a fire restoring signal.

After the system polling for a transmitter, the point polling for a transmitter and the selecting have been completed, the normal system polling, the normal point polling and the selecting are performed.

That is, the normal system polling is performed at P20 shown in FIG. 6, the status of the terminal units, such as the fire detector S, belonging to the group G2 is changed, and the normal point polling is performed at P21 shown in FIG. 6. Namely, the fire detection unit 40 of the fire receiver RE, at P20, transmits code SPAD·CM2 denoting the status information return command in the normal system polling, a pulse is returned at the third timing, the status information return command GAD(g)·CM2 (g is a number which denotes the group which is two in this case) in the normal point polling is transmitted to the terminal unit in the group G2 at P21. Since a pulse is returned from the terminal unit at the second timing, it means that the status of the second terminal unit (the tenth terminal unit) among the four terminal unit belonging to the group G2 has been changed. Thus, the fire detection unit 40 of the fire receiver RE subjects the tenth terminal unit (having address 9) to the selecting at P22 shown in FIG. 6 to require data. That is, the fire detection unit 40 of the fire receiver RE transmits the address of the terminal unit that has received the response signal and the status information return command SAD(n)·CM0 (n is a number denoting the address which is 9 in this case). The terminal unit having the address 9 transmits code SAD(n)·DA (n is 9 in this case and DA is data required to be transmitted) denoting the self-address and the data required to be transmitted to the fire detection unit 40 of the fire receiver RE.

At P22 shown in FIG. 6, the fire detection unit 40 of the fire receiver RE performs an operation required for the signal level of the data DA in accordance with the received data DA. The signal level will now be described. A fire detector usually has, in a case of a smoke detector, three levels from 1 to 3. Specifically, a smoke density converted into an obscuration ratio of 5%/m is determined to level 1, 10%/m is determined to be level 2 and 15%/m is determined to be level 3. The RAM 43 in the fire detection unit 40 of the fire receiver RE stores the fire discrimination levels at which the fire alarm must be issued at respective addresses. Furthermore, linked information (information of, for example, the operation of a terminal unit to be controlled) for each level is stored. Thus, an operation corresponding to the level is performed. The fire detection unit 40 of the fire receiver RE determines whether or not data transmitted from the terminal unit having the address 9 is a signal with which a fire alarm must be issued (for example, a signal of level 2). If the data received from the terminal unit is a signal of the level 1 for example, the fire detection unit 40 of the fire receiver RE, at P23 shown in FIG. 6, transmits to the terminal unit having the address 9 a level stop command SAD(n)·CM5 (n is 9 in this case) denoting a fact that a signal of the foregoing level is not required.

The "level stop command" is a "command for use such that a received level signal of smoke or the like transmitted from a fire detector in the selecting is discriminated, and the received level signal is not the level signal of a desired fire discrimination level the fire detector is stopped to transmit the response signal to the received level signal". Therefore, the fire detector S that has received the level stop command does not respond to the level, the response to which has been stopped.

Use of the foregoing level stop command is effective for a multi-signal-type fire detector which has a plurality of discrimination levels, which makes a fire discrimination at each discrimination level and which transmits a corresponding level signal, the plurality of the discrimination levels consisting of, for example, a level equivalent to a fire of the level 1 (a level for discriminating the fire when the smoke density is 5%) a level equivalent to a fire of the level 2 (a level for discriminating the fire when the smoke density is 10%) and a level equivalent to a fire of the level 3 (a level for discriminating the fire when the smoke density is 15%). That is, the level of the signal received from the multi-signal-type fire detector is discriminated by the fire detection unit 40 of the fire receiver RE. If the fire level of the received level signal is not the level signal corresponding to a desired fire level, a level stop command causing the multi-signal-type fire detector to stop ensuing transmission of the response signal to the received level signal. The multi-signal-type fire detector that has received the level stop command does not respond to the fire detection unit 40 of the fire receiver RE in the system polling and the point polling at the foregoing fire level. Thus, even if the multi-signal-type fire detector repeats turning on and off at a smoke density of a level lower than the level which is discriminated by the receiver RE that a fire takes place, meaningless response signals are not transmitted to the fire detection unit 40 of the fire receiver RE. Therefore, delay of the processes in the fire detection unit 40 of the fire receiver RE can be prevented.

The foregoing embodiment has the arrangement that a plurality of terminal units are subjected to the system polling, the point polling and the selecting in such a manner that the fire determined command is transmitted to the terminal unit, the operation of which has been determined and the response to the fire detection unit 40 of the fire receiver RE in the system polling and the point polling is stopped. The terminal unit, the operation of which has been determined, is a storage type fire detector that has transmitted to the fire detection unit 40 of the fire receiver RE a fire signal and a non-storage type fire detector the storage of which has been completed by the fire detection unit 40 of the fire receiver RE, as well as the transmitter P that has transmitted the fire signal to the fire detection unit 40 of the fire receiver RE.

As described above, a plurality of the terminal units are subjected to the system polling, the point polling and the selecting in such a manner that the fire determined command is transmitted to the terminal unit, the operation of which has been determined, and thus the response to the receiving portion is stopped. Therefore, even if the detection level of smoke or the like repeats rise and fall in the vicinity of the fire level after the operation of the terminal unit has been determined, no response to the receiver is performed. Thus, the process to be performed by the receiver cannot be delayed. When the system is restored, the receiving portion transmits a fire restoring command to the terminal unit. The terminal unit that has received the fire determined command is restored in accordance with the fire restoring command. Also the multi-signal-type fire detector that has received the level stop command is restored in accordance with the fire restoring command.

Figure 7:
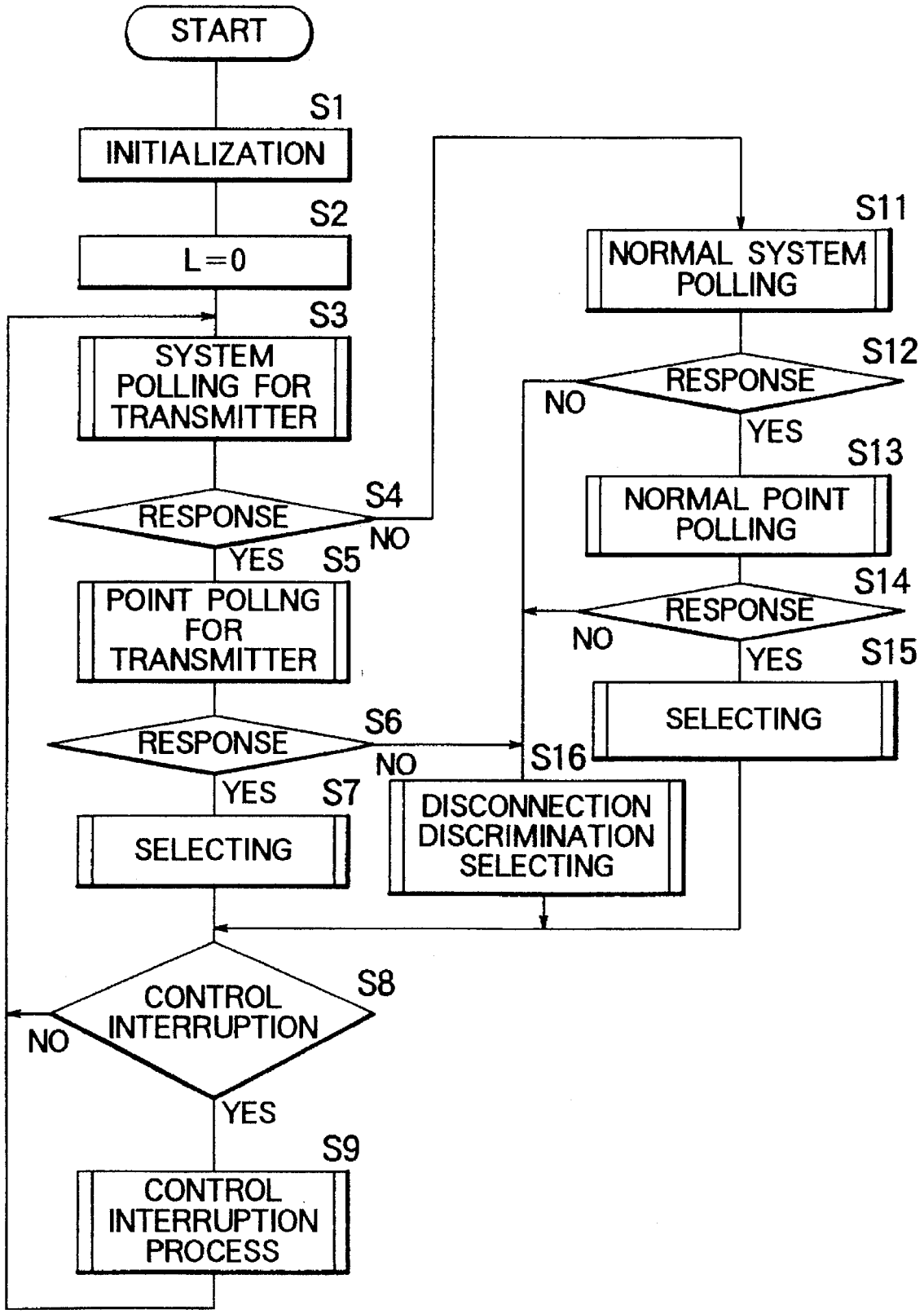
FIG. 7 is a flow chart of the basic operation of a fire detection unit 40 provided for the fire receiver RE according to the foregoing embodiment.

FIG. 7 is a flow chart showing the basic operation of the fire detection unit 40 provided for the fire receiver RE in the foregoing embodiment.

First, initialization is performed, and address L for performing the disconnection discrimination selecting is set to zero (S1 and S2). Prior to performing the normal system polling, the system polling for a transmitter is performed (S3). If a response to the system polling for a transmitter has been made by the transmitter P (S4), the group that has responded as described above is subjected to the point polling for a transmitter (S5). If a response to the point polling for a transmitter has been made by the transmitter P (S6), the transmitter that has made the response is subjected to the selecting (S7). If a control is interrupted, a control interruption process is performed (S8 and S9) and the operation returns to the system polling for a transmitter (S3).

If no response has been made by the transmitter P although the system polling for a transmitter has been performed (S4), it means that no transmitter P is being operated and thus the normal system polling is performed (S11). If a response to the normal system polling is made by the terminal unit (S12), the group that has made the response is subjected to the normal point polling (S13). If a response to the normal point polling has been made by the terminal unit (S14), the terminal unit that has made the response is subjected to the selecting (S15) and the operation proceeds to step S8. If no response has been made to the point polling for a transmitter and the normal point polling (S6 and S14), a discrimination is made that an erroneous response has been made in the system polling due to noise or the like and the disconnection discrimination selecting is performed (S16). Thus, the operation proceeds to step S8. If no response has been made to the normal system polling (S12), also the disconnection discrimination selecting is performed (S16).

Figure 8:
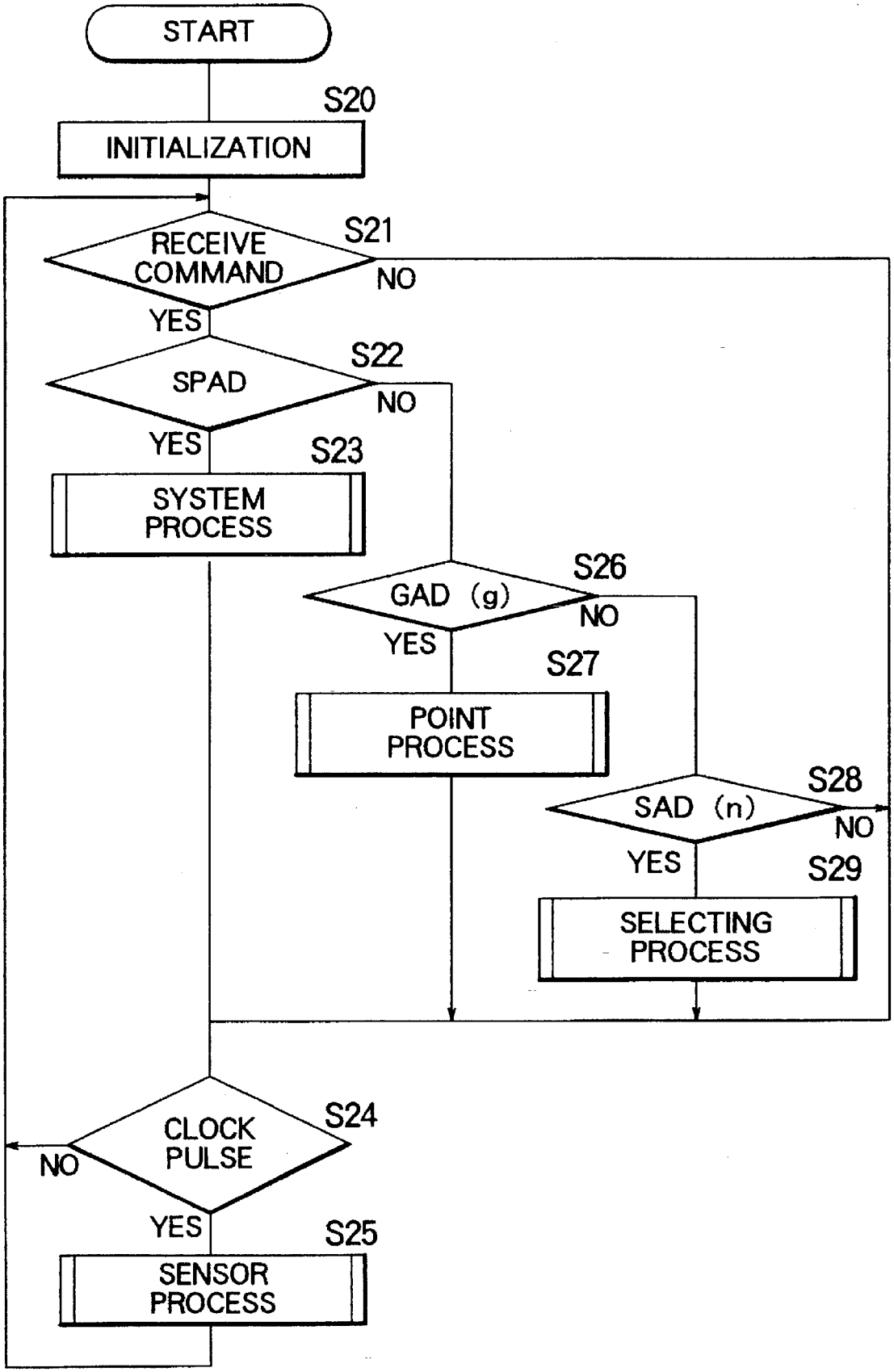
FIG. 8 is a flow chart of the basic operation of the photoelectric smoke detector S which is one of terminal units according to the foregoing embodiment.

FIG. 8 is a flow chart showing the basic operation of the photoelectric smoke detector S which is one of terminal units in the foregoing embodiment.

Initialization is performed (S20). If a command received from the fire detection unit 40 of the fire receiver RE has no appointed address and the subject portion is the command SPAD denoting the normal system polling (S21 and S22), a system process is performed (S23). If a clock pulse has been generated (S24), a sensor process (that is, a smoke detection operation), such as light emission and light receipt, is performed (S25) and the operation returns to step S21. If the command received from the fire detection unit 40 of the fire receiver RE is not the SPAD but it is the command GAD(g) denoting the point polling that appoints the group to which the photoelectric smoke detector S belongs (S22 and S26), a point process is performed (S27). If the signal supplied from the fire detection unit 40 of the fire receiver RE is not the command GAD(g) but it is the command SAD(n) denoting the selecting for appointing the address of the photoelectric smoke detector S (S28), the selecting process is performed (S29).

Figure 9:
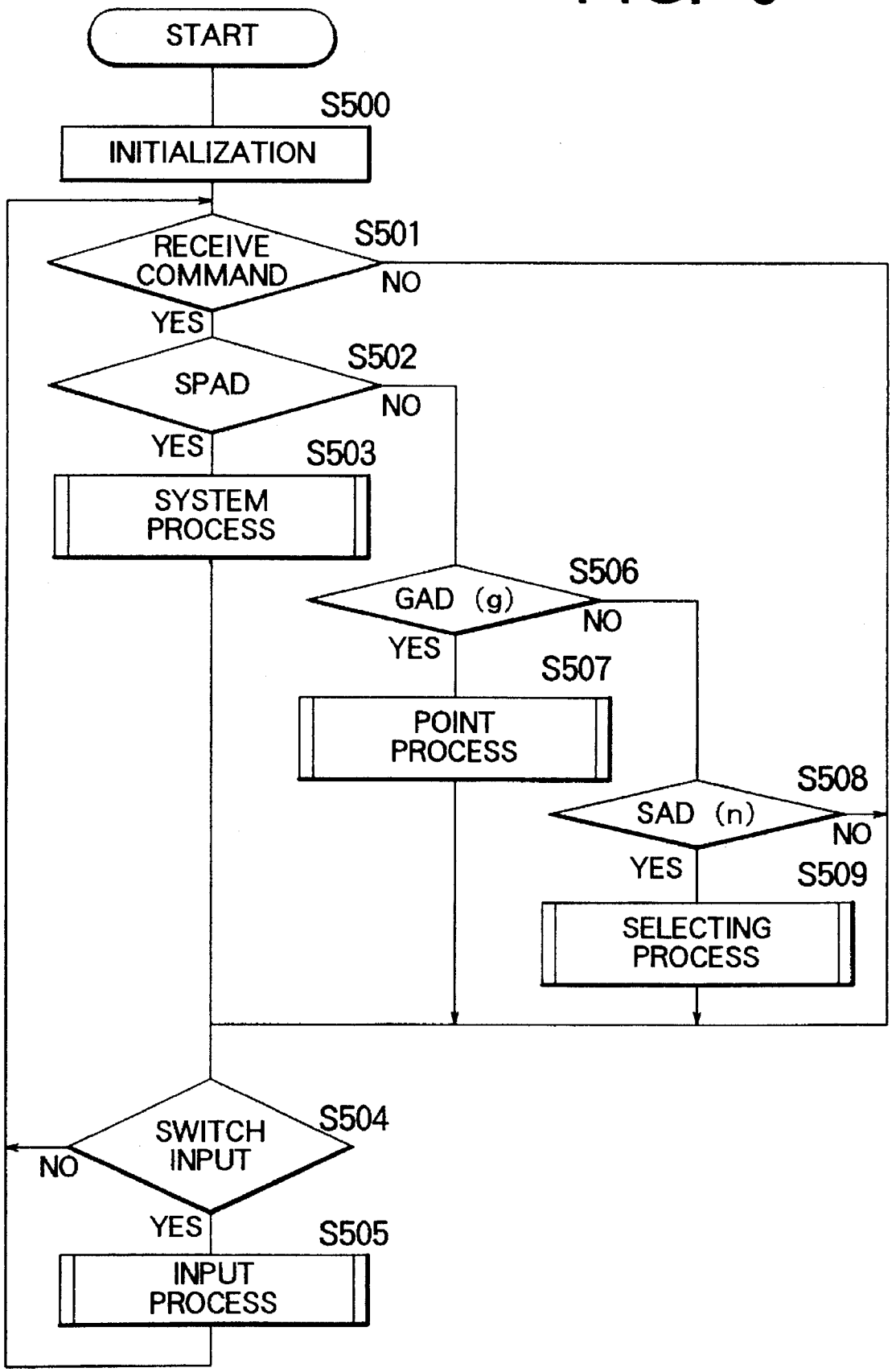
FIG. 9 is a flow chart of the basic operation of the transmitter P according to the foregoing embodiment.

FIG. 9 is a flow chart showing the basic operation of the transmitter P in the foregoing embodiment.

Initialization is performed (S500). If the command received from the fire detection unit 40 of the fire receiver RE has no appointed address and the subject portion is the command SPAD denoting the system polling (S501 and S502), the system process is performed (S503). If a state where a signal has been generated from a switch SW when the push button is depressed (S504), an input process is performed (S505). Then, the flow returns to step S501. If the command received from the fire detection unit 40 of the fire receiver RE is not the SPAD but it is the command GAD(g) denoting the point polling appointing the group to which the transmitter P belongs (S502 and S506), the point process is performed (S507). If the signal received from the fire detection unit 40 of the fire receiver RE is not GAD(g) but it is the command SAD(n) denoting the selecting appointing the address of the transmitter P (S508), the selecting process is performed (S509).

Figure 10:
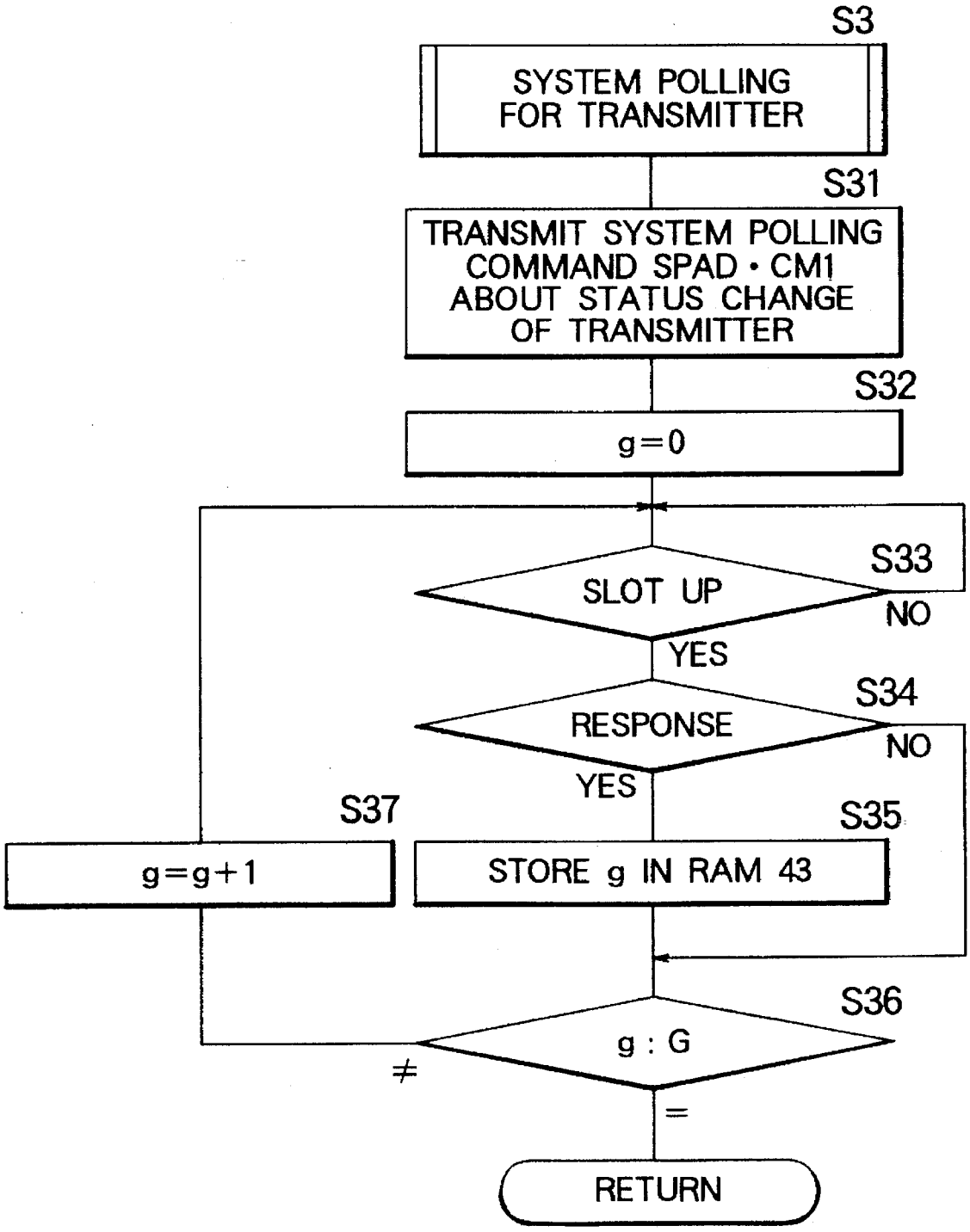
FIG. 10 is a flow chart showing an example of system polling (S3) for a transmitter that is performed by the fire detection unit 40 of the fire receiver RE according to the foregoing embodiment.

FIG. 10 is a flow chart showing a specific example of the system polling for a transmitter (S3) for the fire detection unit 40 of the fire receiver RE according to the foregoing embodiment.

The fire detection unit 40 of the fire receiver RE transmits a command SPAD·CM1 of the system polling for a transmitter that denotes the status information return command about the status change of the transmitter P (S31), the variable g denoting the group number is set to zero (S32) to store the number of the responded group. That is, when the responding timing for the transmitter P belonging to the group G0 has come (S33), and when a response pulse is received from the transmitter P (S34), zero which is the variable g at this time is stored in the RAM 43 (S35). Then, the variable g is increased by one (S37), and the operations S33 to S37 are repeated until the variable g reaches final value G (S36). Then, the flow returns.

Figure 11:
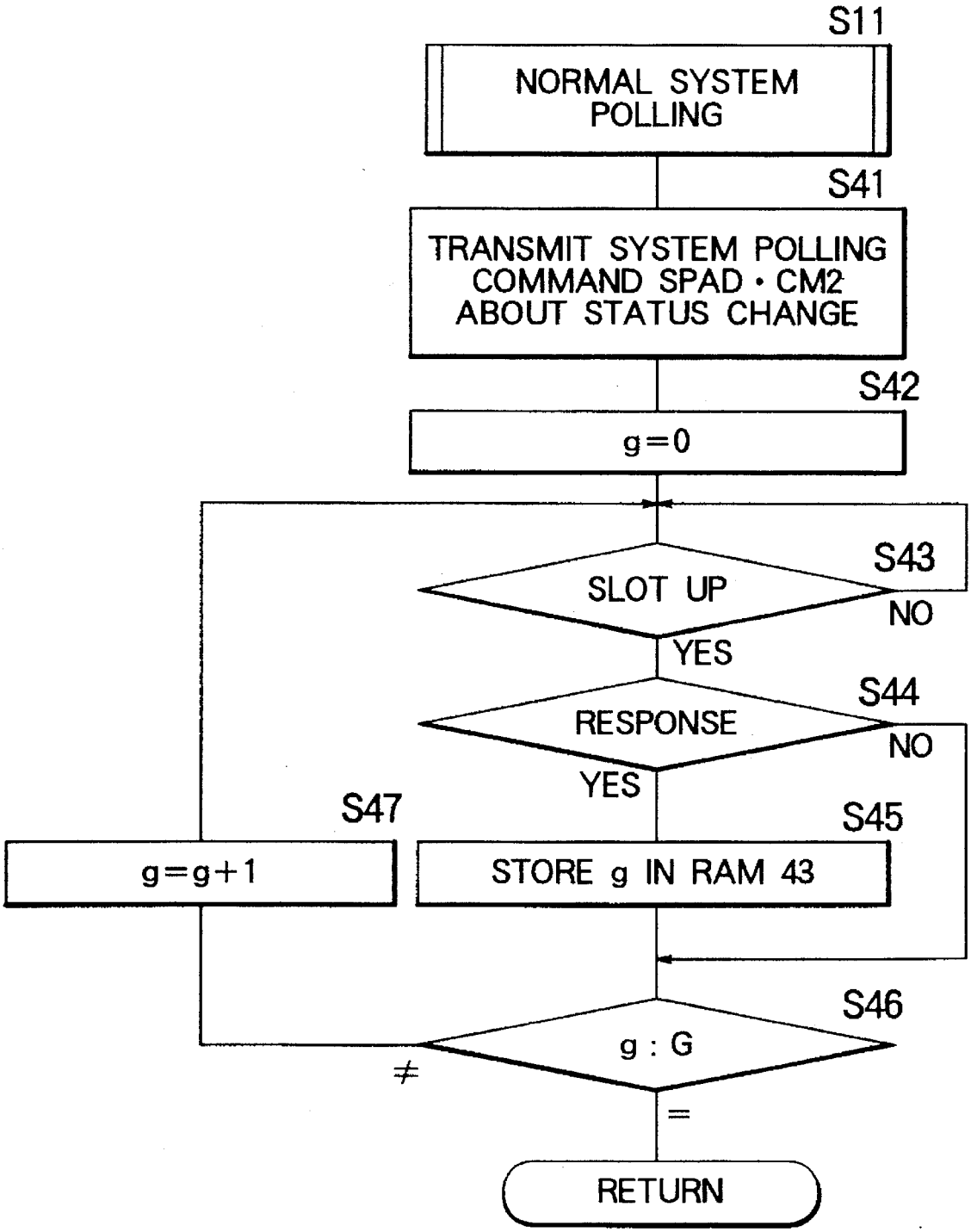
FIG. 11 is a flow chart showing an example of normal system polling (S11) that is performed by the fire detection unit 40 of the fire receiver RE according to the foregoing embodiment.

FIG. 11 is a flow chart showing a specific example of the normal system polling (S11) for the fire detection unit 40 of the fire receiver RE according to the foregoing embodiment.

The fire detection unit 40 of the fire receiver RE transmits command SPAD·CM2 of normal system polling that denotes the status information return command about the status change of the terminal unit (S41), and the variable g denoting the group number is set to zero (S42) to store the number of the group that has made the response. That is, when the responding timing for the terminal unit belonging to the group G0 has come (S43) and when a response pulse from the terminal unit has been received (S44), zero which is the variable g at this time is stored in the RAM 43 (S45). Then, the variable g is increased by one (S47), and the foregoing operations S33 to S37 are repeated until the variable g reaches the final value G (S46). Then, the flow returns.

Figure 12:
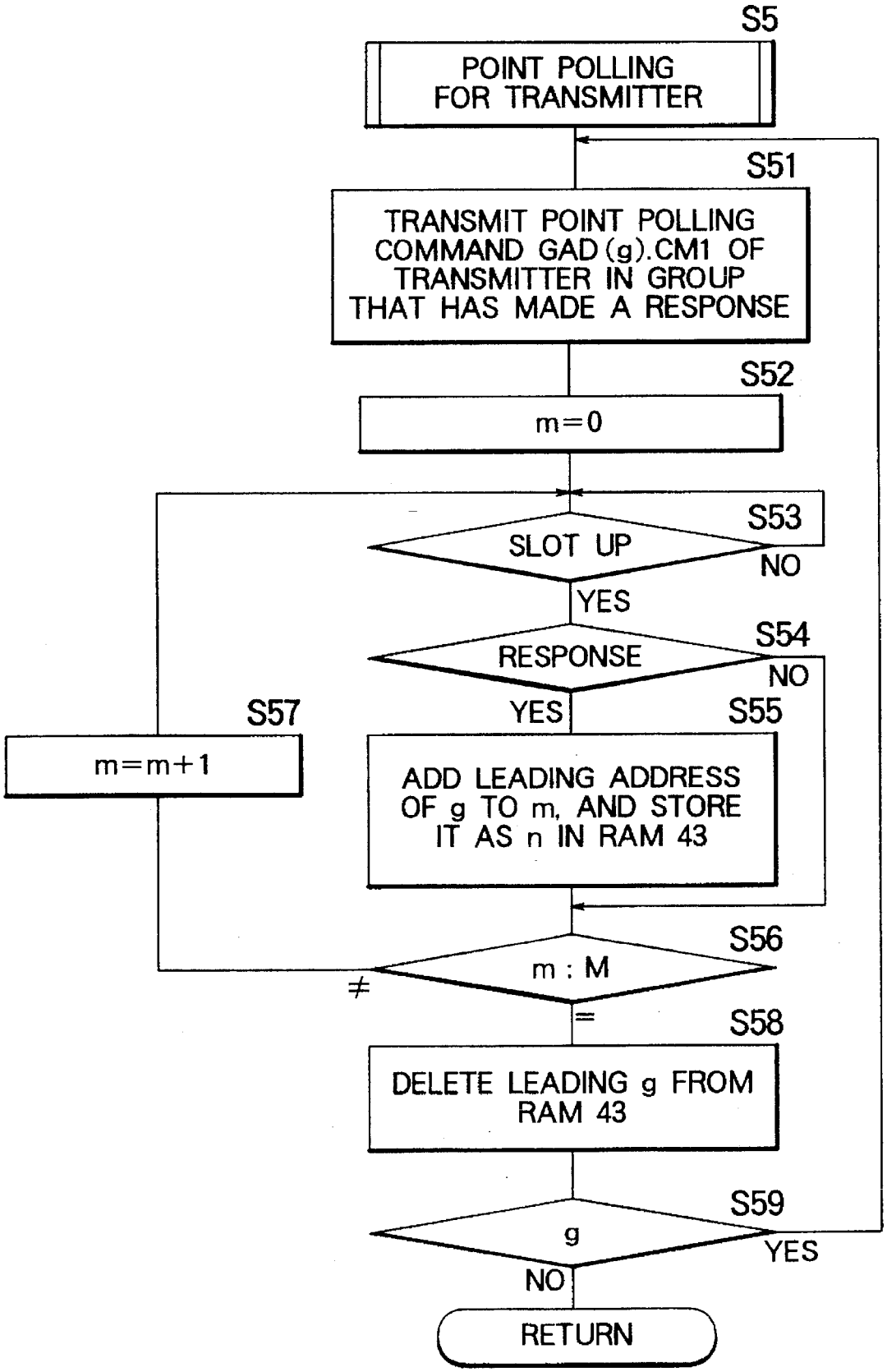
FIG. 12 is a flow chart showing an example of point polling for a transmitter (S5) that is performed by the fire detection unit 40 of the fire receiver RE according to the foregoing embodiment.

FIG. 12 is a flow chart showing a specific example of the point polling for a transmitter (S5) for the fire detection unit 40 of the fire receiver RE according to the foregoing embodiment.

The fire detection unit 40 of the fire receiver RE transmits the command GAD(g)·CM1 of the point polling for a transmitter that denotes the status information return command to be issued to the transmitter P in the group (stored in the RAM 43) to which the transmitter P that has responded to the system polling for a transmitter belongs (S51) to set variable m denoting the number of the transmitter P which is the terminal unit in the group to zero (S52). The number m of the transmitter P in the group that has made the response is converted into address n of the transmitter P and the address n is stored. That is, when the response timing for the m-th transmitter P has come and when a response pulse from the transmitter P has been received (S53 and S54), a value obtained by adding the variable m at this time to the leading address of the group is, as the address n of the transmitter P that has made the response, stored in the RAM 43 (S55). The variable m is increased by one (S57), and the foregoing operations S53 to S57 are repeated until the variable m reaches final value M (S56). When the point polling for a transmitter for all groups g (the numbers of the groups g are stored in the RAM 43) that have responded to the system polling for a transmitter has been completed (S58 and S59), the flow returns.

Figure 13:
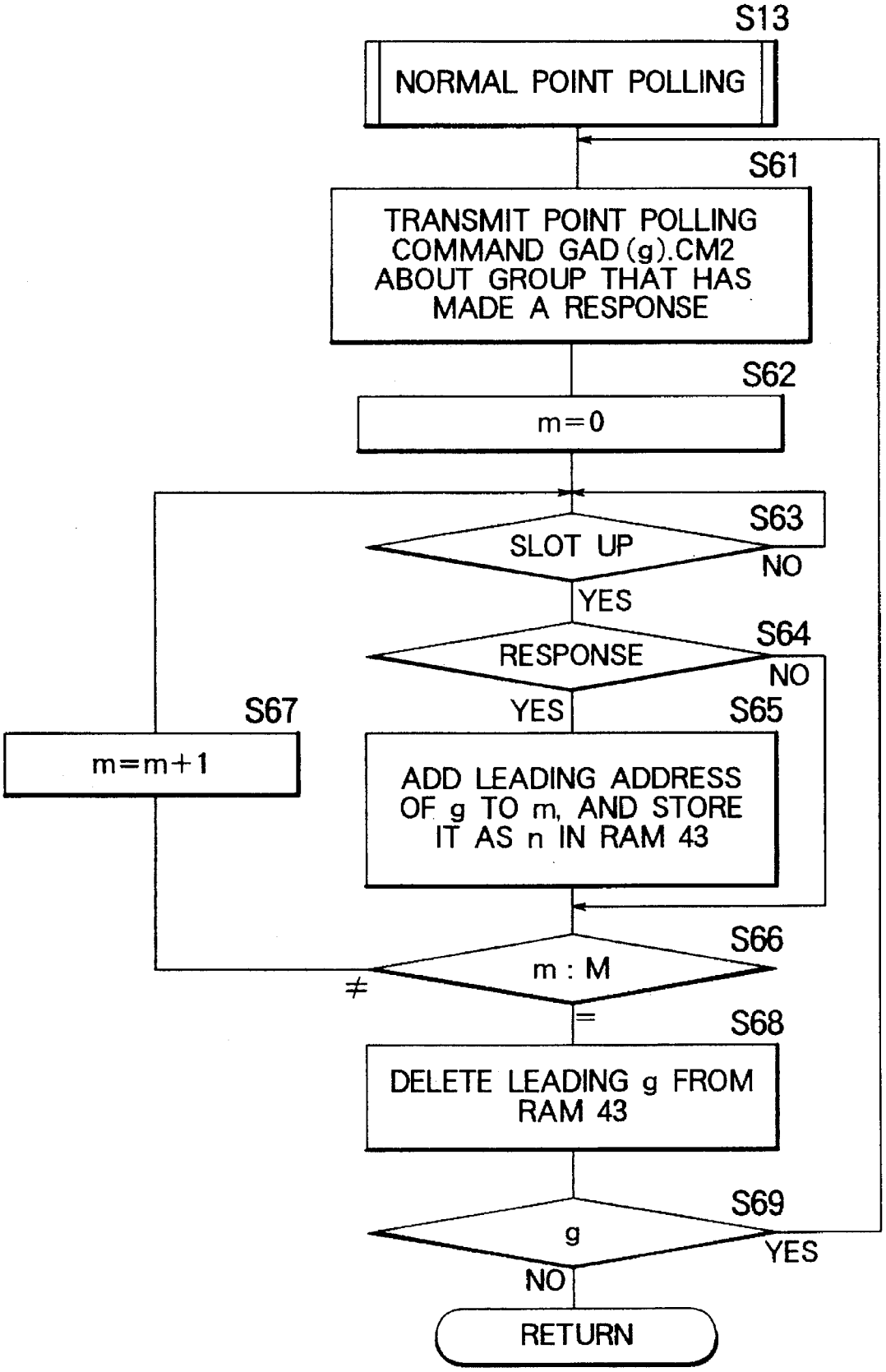
FIG. 13 is a flow chart showing an example of normal point polling (S13) that is performed by the fire detection unit 40 of the fire receiver RE according to the foregoing embodiment.

FIG. 13 is a flow chart showing a specific example of the normal point polling (S13) for the fire detection unit 40 of the fire receiver RE according to the foregoing embodiment.

The fire detection unit 40 of the fire receiver RE transmits a command GAD(g)·CM2 of the normal point polling that denotes the status information return command to be issued to the terminal unit in the group to which the transmitter P that has responded to the normal system polling (S11) belongs (S61). The variable m denoting the number of the terminal unit in the group is set to zero (S62) and the number m of the terminal unit in the group that has made the response is converted into address n and is stored. When the response timing for the m-th terminal unit has come and a response pulse from the terminal unit has been received (S63 and S64), a value obtained by adding the variable m at this time to the leading address of the group is, as the address n of the terminal unit to be selected, stored in the RAM 43, and the variable m is increased by one (S65 and S67). Then, the operations S63 to S67 are repeated until the variable m reaches final value M (S69), and the flow returns.

Figure 14:
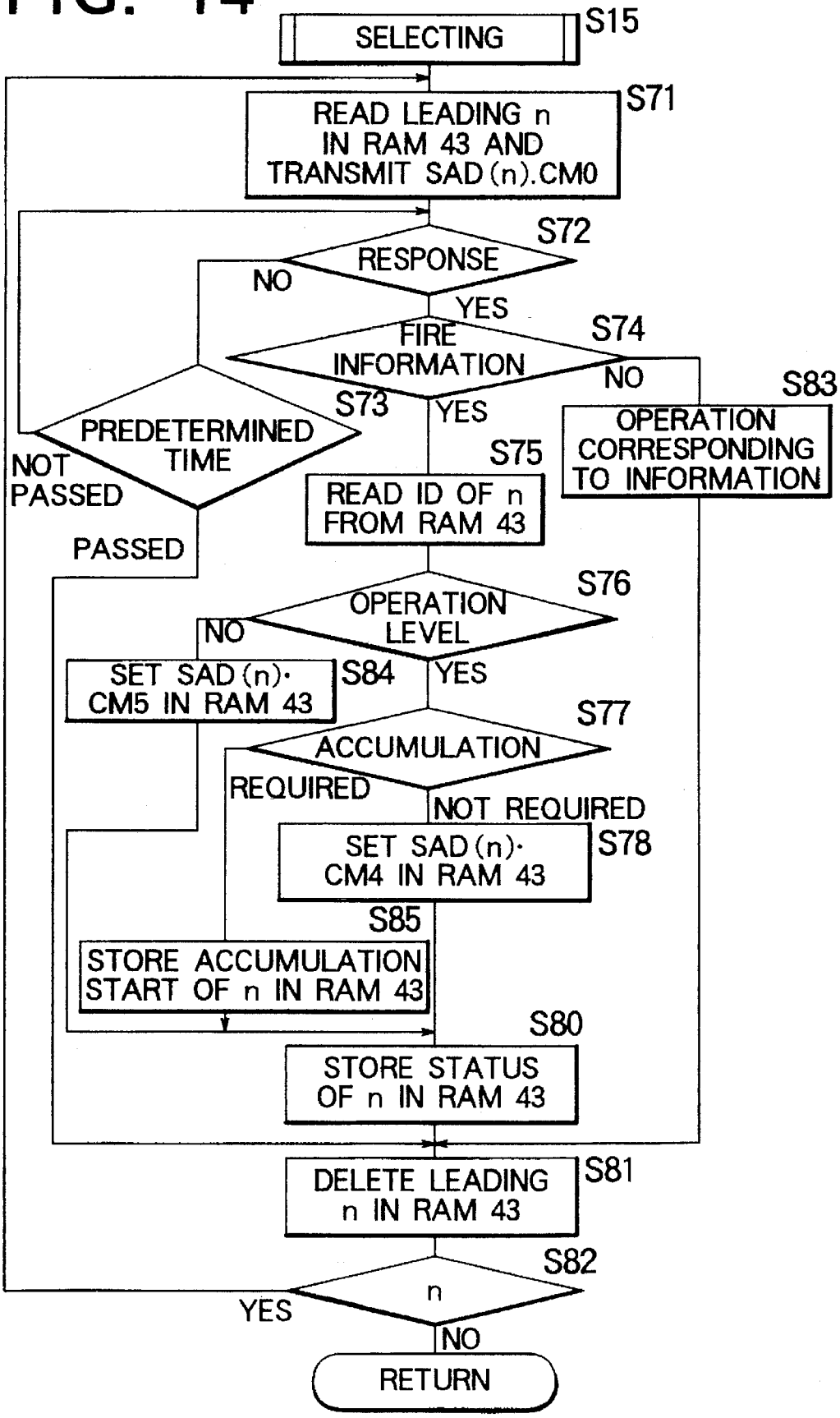
FIG. 14 is a flow chart showing an example of selecting (S7 and S15) that is performed by the fire detection unit 40 of the fire receiver RE according to the foregoing embodiment.

FIG. 14 is a flow chart showing a specific example of the selecting (S7 and S15) for the fire detection unit 40 of the fire receiver RE according to the foregoing embodiment.

The fire detection unit 40 of the fire receiver RE transmits a selecting command SAD(n)·CM0 that appoints the address n read from the leading portion of the addresses of the transmitter P or terminal units except the transmitter P that has responded in the point polling for a transmitter (S5) or the normal point polling (S13) and stored in the RAM 43 (S71), selecting command SAD(n)·CM0 also denoting the status information return command. When a receipt from the terminal unit having the appointed address n (that is, called by the selecting) has been made and if it is fire information (a signal relating to change in the physical quantity of a fire phenomenon, for example, a level-2 signal or a signal relating to a fire operation, such as an operation signal of the transmitter P) (S72 and S74), type ID of the terminal unit having the address n is read from the RAM 43 (S75).

If the fire information has reached the fire discrimination level for the ID (in a case where the ID is a detector of the level 2 a signal of a fire level 2 has been transmitted) and if no accumulation is required (S76 and S77), a discrimination of fire occurrence can be made assuredly. Therefore, fire of the terminal unit having the address n is determined. A command SAD(n)·CM4 denoting the fire determined command for inhibiting the terminal unit having the address n to respond to the system polling and the point polling is set into the RAM 43 (S78).

Then, the status of the terminal unit having the address n is stored in the RAM 43 (S80), and the leading address n is deleted from the RAM 43 (S81). In a case where the received fire information received has not reached the fire discrimination level corresponding to the ID of the terminal unit (S76), a level stop command SAD(n)·CM5 for stopping ON-OFF response at the non-required level is set into the RAM 43 (S84), and the operation proceeds to step S80. If accumulation is required (S77), accumulation start is stored in the RAM 43 (S85), and the operation proceeds to step S80. If the address n is left in the RAM 43, the operations S71 to S81 are repeated until the left address n has been processed (S82).

Figure 15:
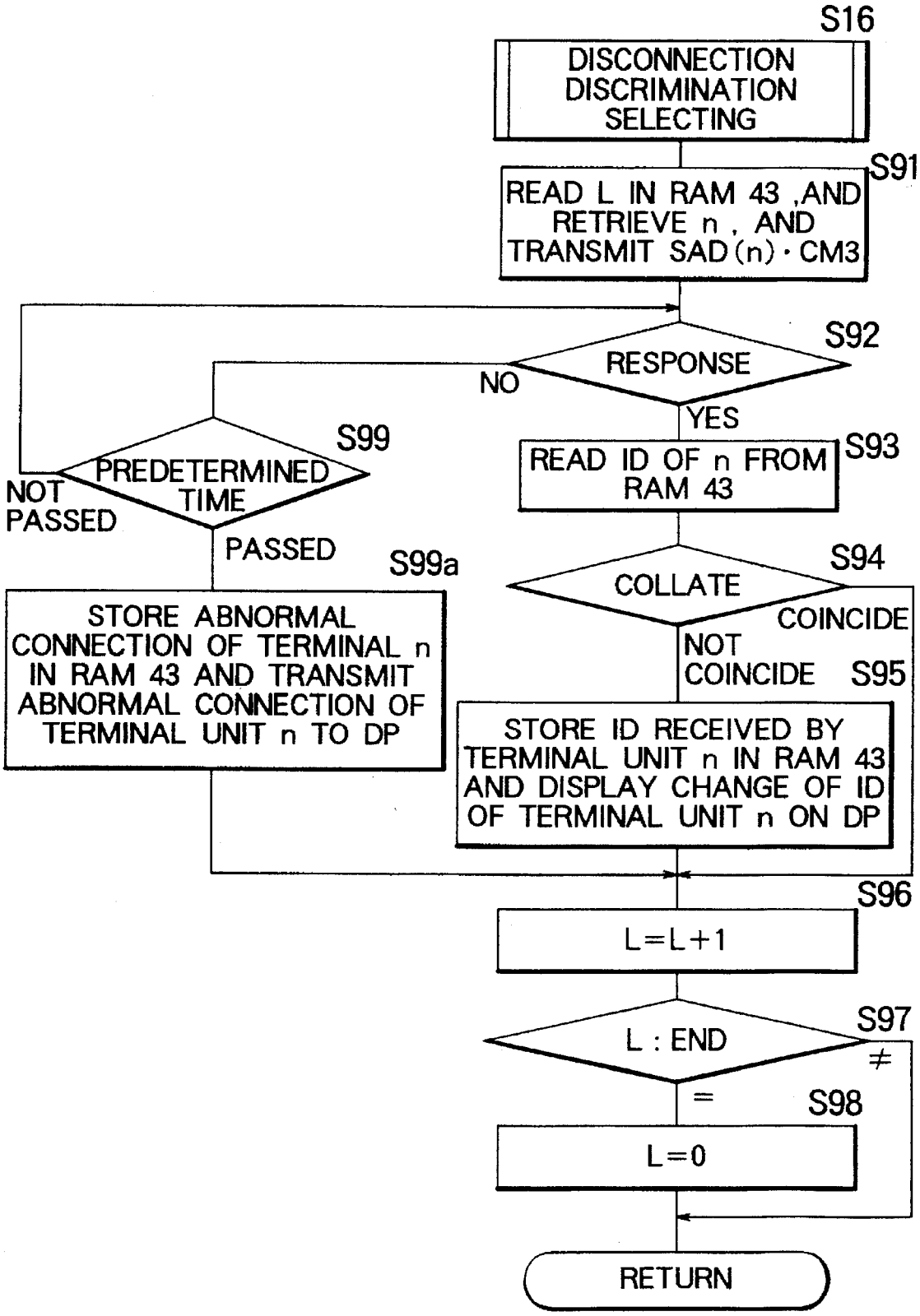
FIG. 15 is a flow chart showing an example of disconnection discrimination selecting (S16) that is performed by the fire detection unit 40 of the fire receiver RE according to the foregoing embodiment.

FIG. 15 is a flow chart showing a specific example of the disconnection discrimination selecting (S16) to be performed by the fire detection unit 40 of the fire receiver RE according to the foregoing embodiment.

The fire detection unit 40 of the fire receiver RE reads, from the RAM 43, the address L (which is the same as the address n but which is individually provided because it must be stored individually) of a terminal unit to be subjected to a disconnection discrimination. Then, the fire detection unit 40 of the fire receiver RE transmits disconnection discrimination selecting command SAD(L)·CM3 for requiring type information for discriminating disconnection (S91). When the fire detection unit 40 of the fire receiver RE receives a signal from a terminal unit (S92), the fire detection unit 40 of the fire receiver RE reeds the type ID of the terminal unit having the address L from the RAM 43 (S93). If the type received from the terminal unit having the address L does not coincide with the type read from the RAM 43 (S94), the type received from the terminal unit having the address L is stored in the RAM 43 and the change in the type of the terminal unit having the address L is displayed on the display portion DP (S95).

The address L of the terminal unit is increased by one (S96). When the address L reaches the final address, the address L is returned to zero (S98). If no signal is received from the terminal unit in a predetermined time (S99), a discrimination is made that the terminal unit having the address L is connected abnormally and this fact is stored in the RAM 43. Furthermore, a signal denoting that the terminal unit having the address L is connected abnormally (that is, a signal denoting a disconnection state) is transmitted to the display portion DP (S99*a*).

Figure 16:
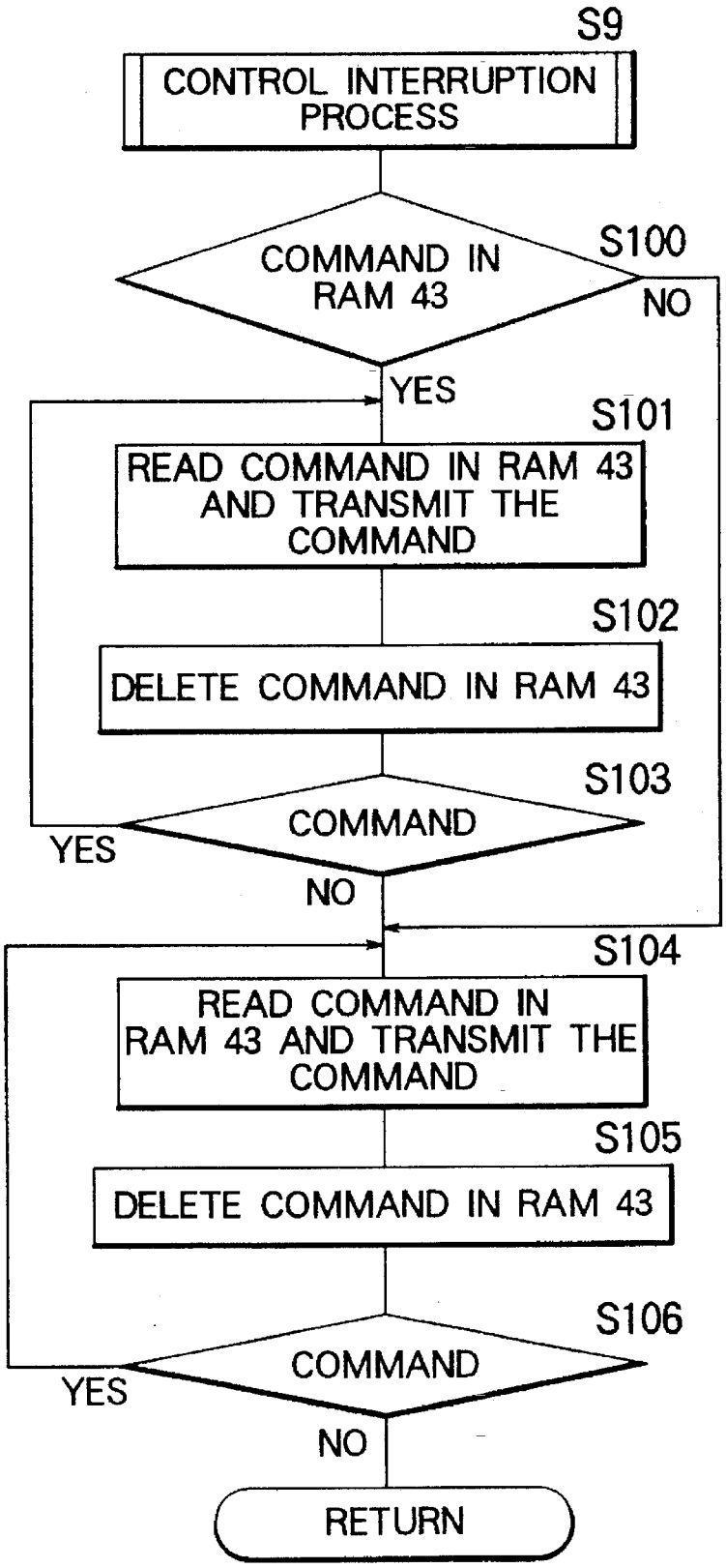
FIG. 16 is a flow chart showing an example of control interruption process (S19) that is performed by the fire detection unit 40 of the fire receiver RE according to the foregoing embodiment.

FIG. 16 is a flow chart showing a control interruption process (S19) to be performed by the fire receiver RE according to the foregoing embodiment.

If a command common to all terminal units (for example, a restoration command) has been stored in the RAM 43 (S100), the common command is read, the command is transmitted by the normal system polling (S101), and the transmitted command is deleted from the RAM 43 (S102). If another common command to all terminal units is left in the RAM 43, reading, transmitting and deleting of the command are repeated (S103). Then, commands, such as the fire determined command and the level stop command, to be transmitted to the terminal unit appointed with the address are read from the RAM 43. The commands are transmitted by the selecting operation (S104), and the transmitted commands are deleted from the RAM 43 (S105). If another command for appointing the terminal unit is left in the RAM 43, reading, transmitting and deleting the command are repeated (S106).

Figure 17:
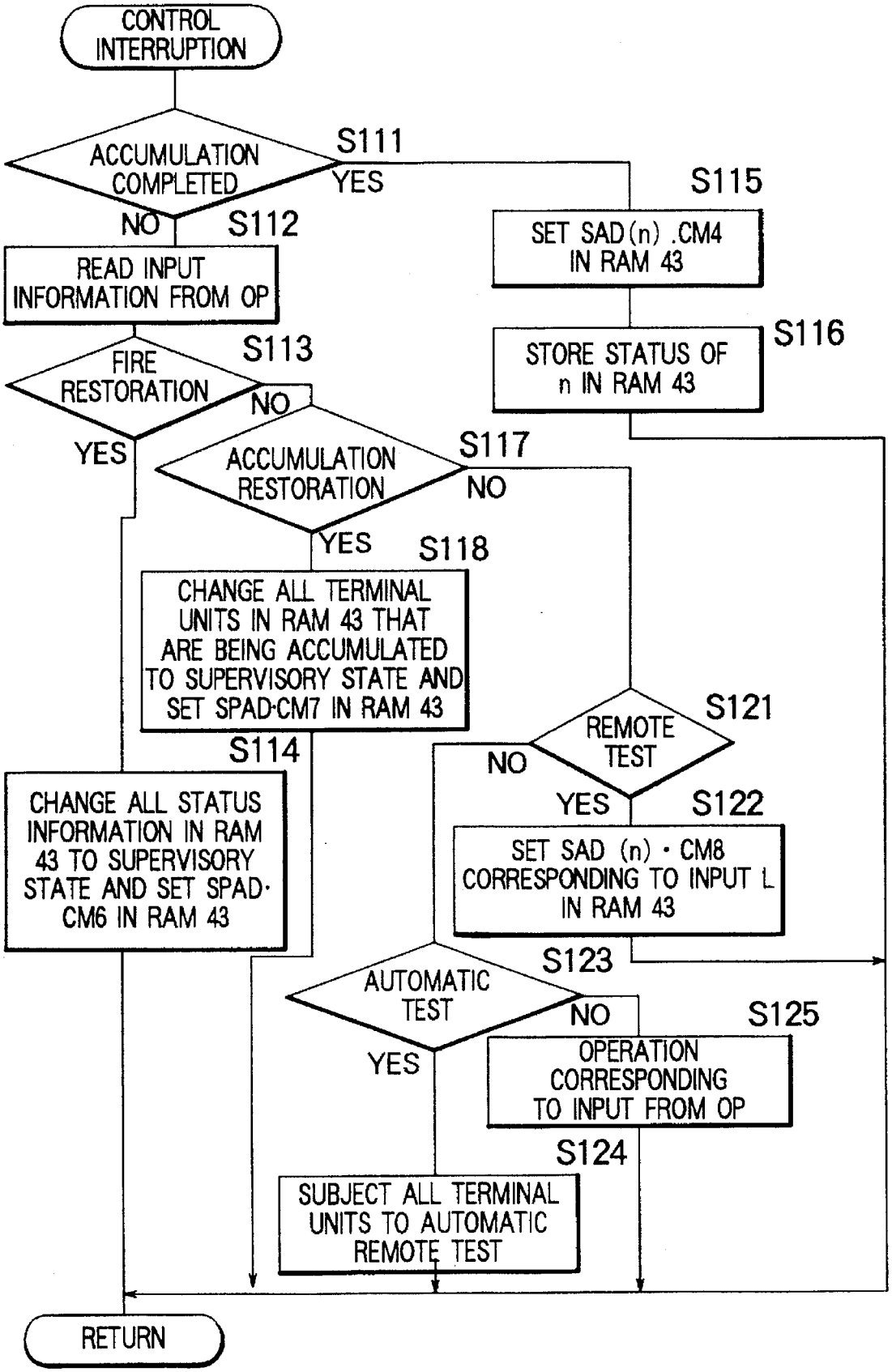
FIG. 17 is a flow chart showing an example of the control interruption that is performed by the fire detection unit 40 of the fire receiver RE according to the foregoing embodiment and that is generated arbitrarily.

FIG. 17 is a flow chart showing a specific example of the control interruption to be performed by the fire detection unit 40 of the fire receiver RE according to the foregoing embodiment and which is generated arbitrarily.

The control interruption to be performed by the fire detection unit 40 of the fire receiver RE is an operation for processing input information from the operation portion OP. The control interruption is also generated in a case where the accumulation of the fire detector has been completed by the internal process, although the detailed description of this is omitted. In a case where the accumulation of the fire detector has been completed (S111), fire determined command SAD (n)·CM4 to be issued to the terminal unit having the address n determined to be fire due to the completion of the accumulation is set to RAM 43 (S115). The status of the terminal unit having the address n is stored in the RAM 43 (S116) and the operation is returned.

If the accumulation has not been completed (S111), input information from the operation portion OP is read (S112) because the interruption was made by the input from the operation portion OP. If a fire restoration input in a case where the system is restored from the fire alarm state to the supervised state is made (S113), all status information in the RAM 43 is cleared to restore the supervised state and the command SPAD·CM6 denoting the fire restoration command is set to RAM 43 (S114). Then, the operation is returned.

If the input information from the operation portion OP is accumulation restoration input for suspending the accumulation of the terminal unit (the fire detector) brought into the accumulated state (S117), all terminal units that are being accumulated in the RAM 43 are changed to the supervised state and the command SPAD·CM7 denoting the accumulation restoration command is set into the RAM 43 (S118). Then, the operation is returned.

If the input information from the operation portion OP is remote test input for starting a test of the terminal unit, such as the fire detector (S121), command SAD(n)·CM8 denoting a remote test command to be issued to the terminal unit having the address n and supplied from the operation portion OP is set to the RAM 43 (S122), and the operation is returned. If the input information from the operation portion OP is automatic test input for automatically testing the terminal unit (S123), all terminal units are automatically subjected to a remote test process (S124), and the operation is returned. If the input information from the operation portion OP is another input, a process corresponding to the input from the operation portion OP is performed (S125).

Figure 18:
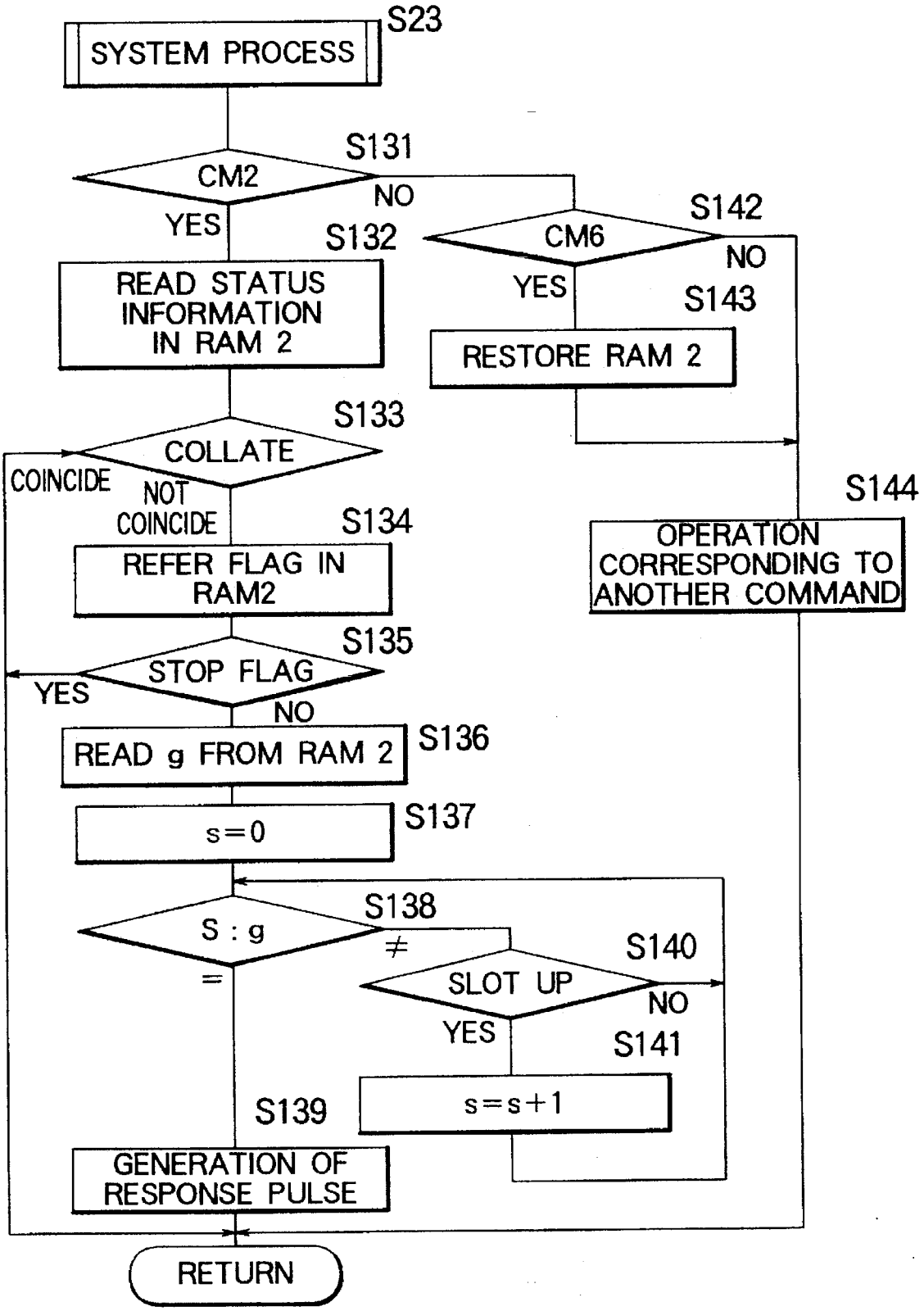
FIG. 18 is a flow chart showing an example of a system process (S23 shown in FIG. 8) that is performed by the photoelectric smoke detector S according to the foregoing embodiment.

FIG. 18 is a flow chart showing a specific example of a system process (S23 shown in FIG. 8) to be performed by the photoelectric smoke detector S according to the foregoing embodiment.

If the command received from the receiver RE is command SPAD denoting the system polling (S22) and it is the status information return command CM2 that requires status change information (S131), the present status information and status information that has been transmitted are read from the RAM 2 (S132). If the two status information items do not coincide with each other, it means that the status of the photoelectric smoke detector S has been changed. At this time, a reference to a flag in the RAM 2 is made (S134). If response stop flags, such as a level stop flag and the fire determined flag, are not present in the system polling and the point polling (S135), the number g of the group to which the photoelectric smoke detector S belongs is read from the RAM 2 (S136) and slot number s denoting the response timing to the system p is set to zero (S137).

The moment the slot number s and the group number g coincide with each other (S138) is the moment the response timing has come. At this time, a response pulse is transmitted (S139) and a response to the fire detection unit 40 of the fire receiver RE is made. If the slot number s and the group number g do not coincide with each other (S138), the slot number is increased by one when the transmission timing of the number s has come (S140 and S141) to collate the slot number s and the group number g (S138).

If the command received from the fire detection unit 40 of the fire receiver RE is not the status information return command CM2 (S131) but it is fire restoration command CM6 (S142), the present status information, the status information that has been transmitted and the various flags stored in the RAM 2 are deleted. If the command is another command, a process corresponding to the other command is performed (S144).

Figure 19:
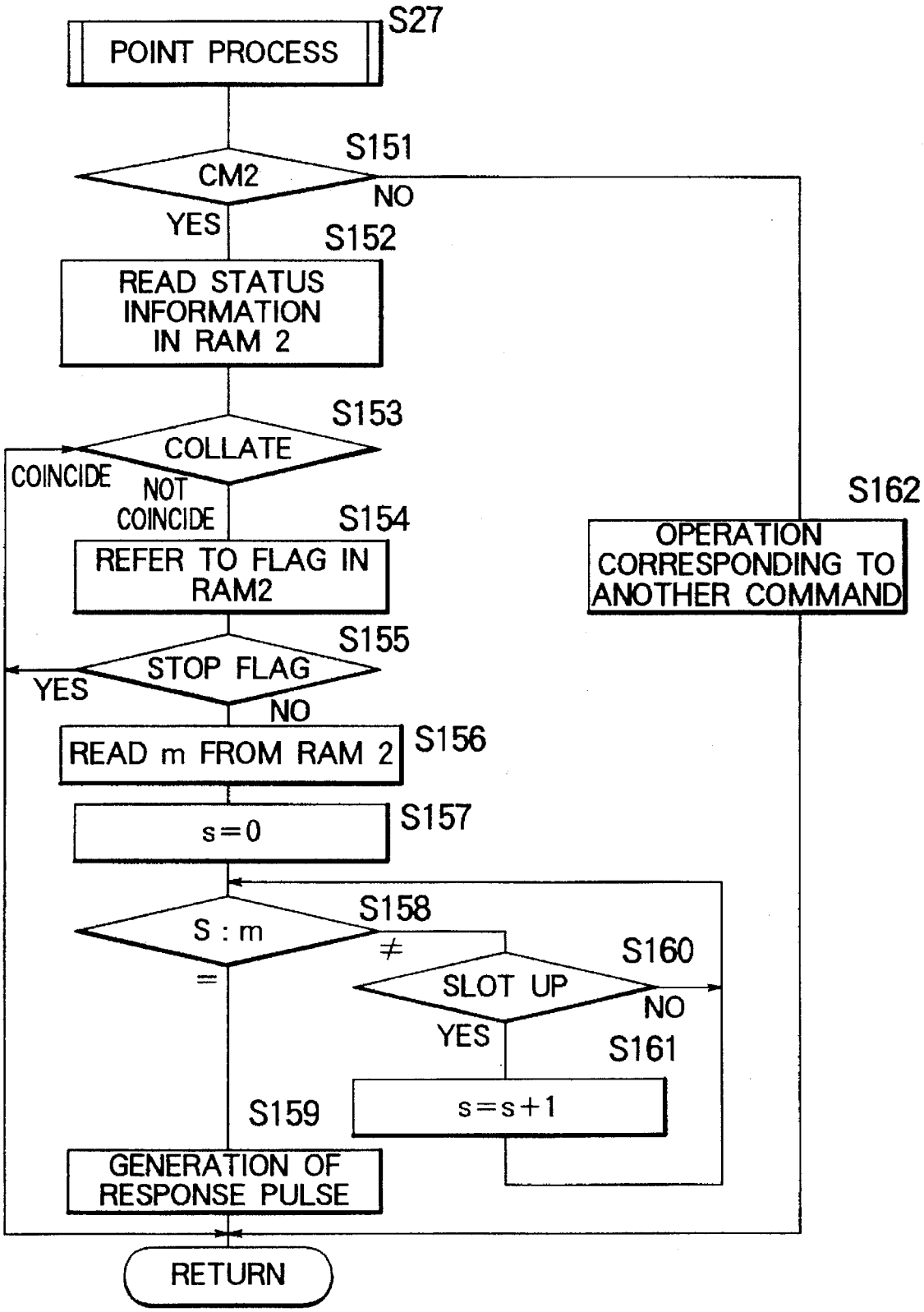
FIG. 19 is a flow chart showing an example of a point process (S27) that is performed by the photoelectric smoke detector S according to the foregoing embodiment.

FIG. 19 is a flow chart showing a specific example of the point process (S27) to be performed by the photoelectric smoke detector S according to the foregoing embodiment.

If the command received from the fire detection unit 40 of the fire receiver RE is code GAD(g) of the point polling appointing the group g to which the photoelectric smoke detector S belongs (S26) and as well as it is the status information return command CM2 that requires the status change information (S151), the present status information and the status information that has been transmitted are read from the RAM 2 (S152). If the two status information items do not coincide with each other (S153), it means that the status of the photoelectric smoke detector S has been changed. At this time, a reference to the RAM 2 is made (S154). If the response stop flag is not stored (S155), a state that the status information in the RAM 2 can be transmitted to the fire detection unit 40 of the fire receiver RE is realized. Therefore, the number m of the photoelectric smoke detector S in the group is read from the RAM 2 (S156) and the slot number s is set to zero (S157).

When the slot number s and the number m in the group coincide with each other (S158), a response pulse is transmitted to the fire detection unit 40 of the fire receiver RE (S159) to respond to the fire detection unit 40 of the fire receiver RE. If the slot number s and the number m in the group do not coincide with each other (S158), the slot number s is increased by one when the transmission timing of the slot number s has passed (S160 and S161). The slot number s and the number m in the group are collated (S158). If the command received from the fire detection unit 40 of the fire receiver RE is not CM2 (S151) but it is another command, a process corresponding to the command is performed (S184).

Figure 20:
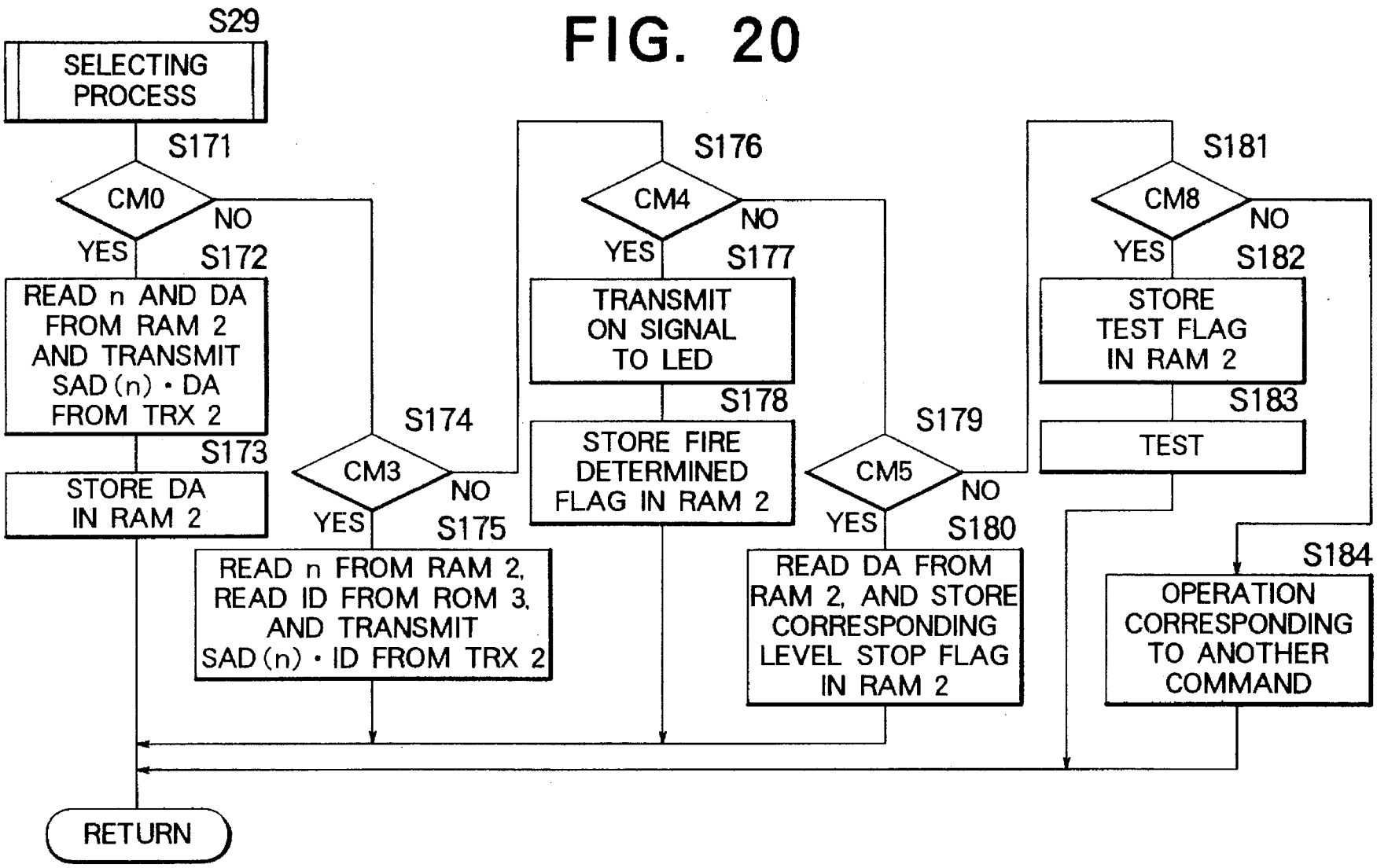
FIG. 20 is a flow chart showing an example of a selecting process (S29) that is performed by the photoelectric smoke detector S according to the foregoing embodiment.

FIG. 20 is a flow chart showing a specific example of the selecting process (S29) to be performed by the photoelectric smoke detector S according to the foregoing embodiment.

If the command received from the fire detection unit 40 of the fire receiver RE is command SAD(n) appointing the address n of the fire detector S (S28 shown in FIG. 8) and as well as it is status information return command CM0 in the selecting (S171), the address n of the terminal unit and data DA (for example, a level 2 signal) denoting the present status information are read from the RAM 2. Furthermore, code SAD(n)·DA denoting the status change of the photoelectric smoke detector S is transmitted from the signal transmitting/receiving portion TRX 2 (S172), and data DA that has been transmitted is stored in the RAM 2 (S173). If the command received from the fire detection unit 40 of the fire receiver RE is not the status information return command CM0 but it is the command CM3 (that is the disconnection discrimination selecting) that requires the type information (S171 and S174), the address n of the terminal unit is read from the RAM 2, the type information ID of the detector S is read from the ROM 3, and code SAD(n)·ID denoting the type information is transmitted from the signal transmitting/receiving portion TRX 2 (S175).

If the command received from the fire detection unit 40 of the fire receiver RE is the fire determined command CM4 (S176), a turning-on signal is transmitted to the operation confirmation lamp LED to turn on the LED (S177).

Furthermore, a fire determined flag for stopping the responses to the fire detection unit 40 of the fire receiver RE in the system polling and the point polling in accordance with the ensuing status information is stored in the RAM 2 (S178). If the command received from the fire detection unit 40 of the fire receiver RE is the command CM5 denoting the level stop command (S179), data DA (for example, e level 1 signal) of the status to be stopped is read from the RAM 2, and a level stop flag for stopping response to the fire detection unit 40 of the fire receiver RE in the system polling and the point polling in only the foregoing state is stored in the RAM 2 (S180).

If the command received from the fire detection unit 40 of the fire receiver RE is the command CM8 denoting the remote test command (S181), a test flag is stored in the RAM 2 (S182), and the test process is performed (S183). If the command is another command, a process corresponding to the command is performed (S162).

Figure 21:
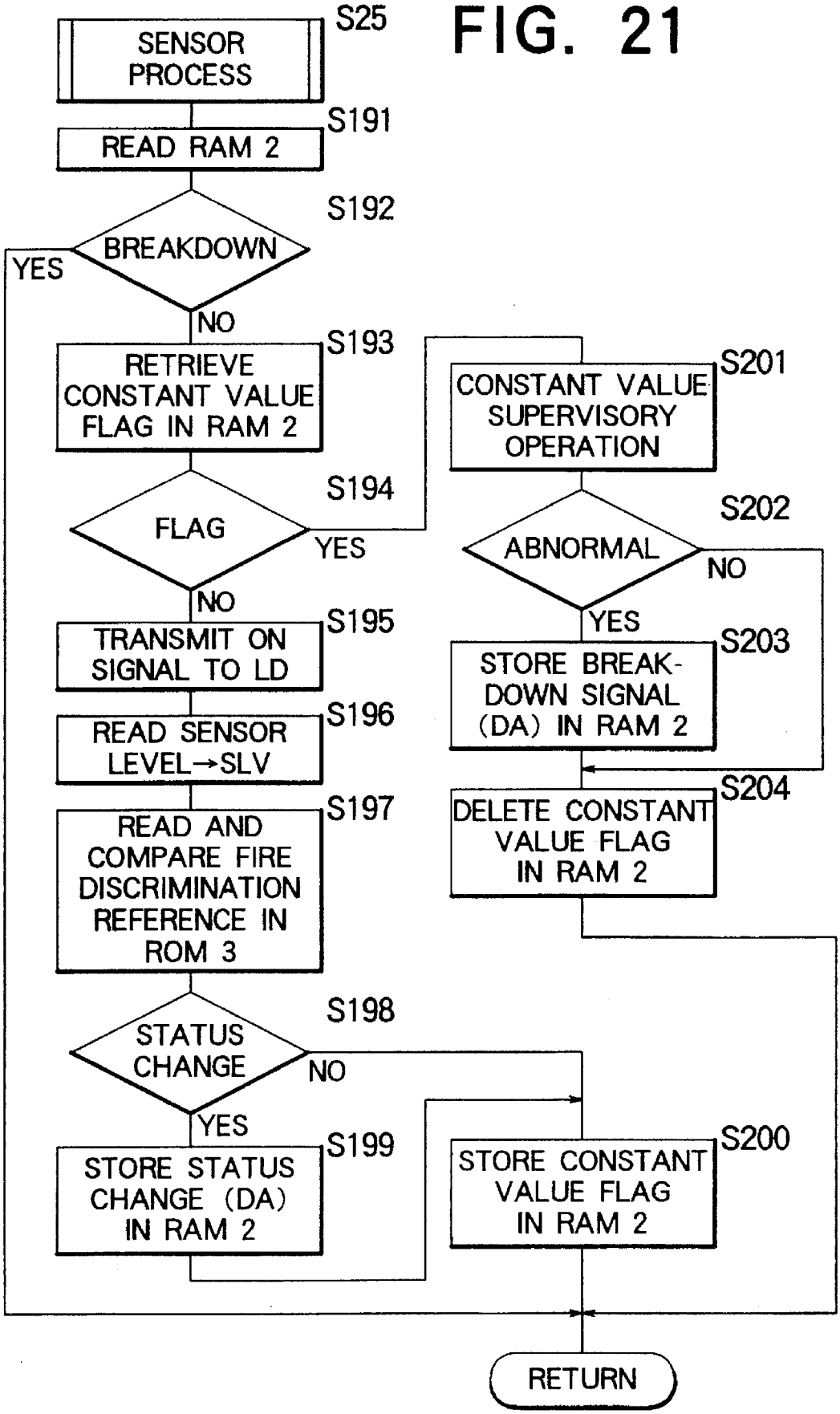
FIG. 21 is a flow chart showing an example of a sensor process (S25) that is performed by the photoelectric smoke detector S according to the foregoing embodiment.

FIG. 21 is a flow chart showing a specific example of a sensor process (S25) to be performed by the photoelectric smoke detector S according to the foregoing embodiment.

The present status information is read from the RAM 2. If the state is not the breakdown state (S191 and S192) and as well as a constant value flag denoting that a constant value supervisory process is performed is not stored in the RAM 2 (S193 and S194), a fire discrimination process is performed. The fire discrimination process is performed in such a manner that a turning on signal is transmitted to the light emitting diode LD (S195), the sensor level is read from the interface IF 23 to make it as SLV (S196), the fire discrimination reference stored in the ROM 3 is read and the sensor level SLV is subjected to a comparison with the fire discrimination reference (S197). In a case where the photoelectric smoke detector S is a multi-signal type detector, it has a plurality of fire levels from level 1 to level 3 as the fire discrimination reference.

The photoelectric smoke detector S discriminates that the state is fire state level 1, level 2 or level 3. If the state detected by the photoelectric smoke detector S has been changed (S198), data DA (for example, the level 1 signal) denoting the present state and a constant value flag for causing the constant value supervisory process to be performed are stored in the RAM 2 (S200).

In a case where the constant value flag is stored in the RAM 2 (S194), the fire discrimination process is not performed but a constant value (which is the quantity of noise light in a normal state and which is the noise light quantity that is changed due to contamination and deterioration) for confirming the function of the photoelectric smoke detector S is detected to perform the constant value supervisory process for confirming whether or not the constant value is included in a predetermined range (S201). If the value is not included in the range, a discrimination is made that the state is abnormal. If an abnormal state has been confirmed (S202), breakdown data is stored in the RAM 2 (S203) and the constant value flag stored in the RAM 2 is deleted (S204).

Figure 22:
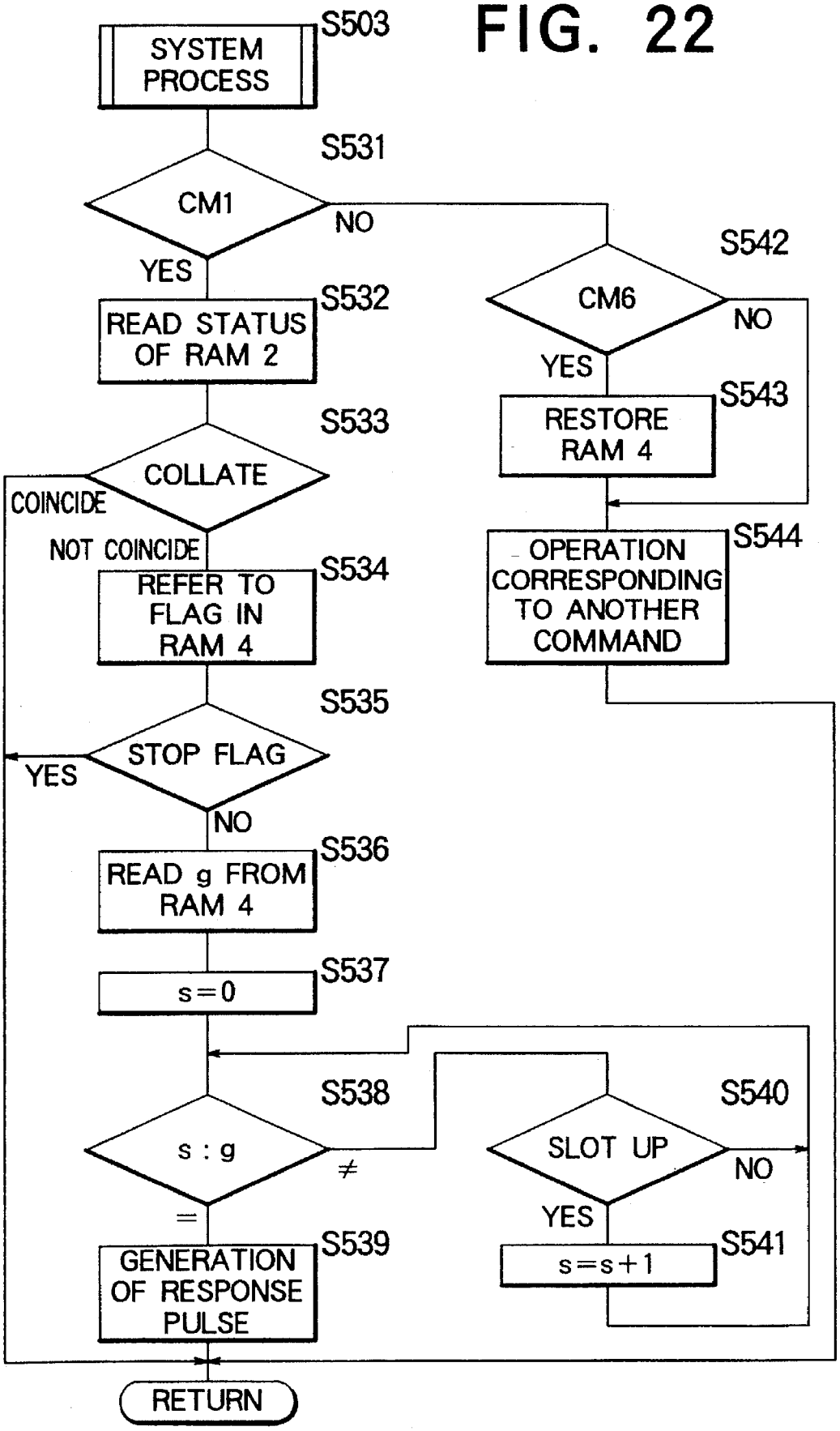
FIG. 22 is a flow chart showing an example of a system process (S503) that is performed by the transmitter P according to the foregoing embodiment.

FIG. 22 is a flow chart showing a specific example of the system process (S503) to be performed by the transmitter P according to the foregoing embodiment.

If the command received from the fire detection unit 40 of the fire receiver RE is the system polling command SPAD (S502 shown in FIG. 9) and as well as it is the status information return command CM1 that requires only the transmitter P to supply the status change information (S531), the present status information is read from the RAM 32, and the status information that has been transmitted is read from the RAM 2 (S532). If the two status information items do not coincide with each other (S533), it means that the state of the transmitter P has been changed. Thus, a reference to the flag in the RAM 4 is made (S534). If response stop flags, such as the fire determined flag, for the system polling and the point polling are not stored (S535), the number g of the group to which the transmitter P belongs is read from the RAM 4 (S536). Furthermore, slot number s denoting the response timing to the system polling is set to zero (S537).

If the slot number s and the group number g coincide with each other (S538), a response pulse is transmitted (S539) to respond to the fire detection unit 40 of the fire receiver RE. If the slot number s and the group number g do not coincide with each other (S538), the slot number s is increased by one when the transmission timing for the number s has passed (S540 and S541) to collate the slot number s and the group number g (S538).

If the command received from the fire detection unit 40 of the fire receiver RE is not the status information return command CM1 (S531) but it is the fire restoration command CM6 (S542), the present status information, the status information that has been transmitted and the various flags stored in the RAM 4 are deleted (S543). If the command is another command, a process corresponding to the command is performed (S544).

In the system process (S503), a response to the status information return command that requires normal status change information is permitted as well as the response to the status information return command CM1 that requires only the transmitter P to supply the status change information. In this case, the transmitter P is brought into the fire determined state simultaneously with the alarm issue. If the fire determination has been made, no response to the fire detection unit 40 of the fire receiver RE is permitted. Therefore, a problem of the double response can be prevented.

Figure 23:
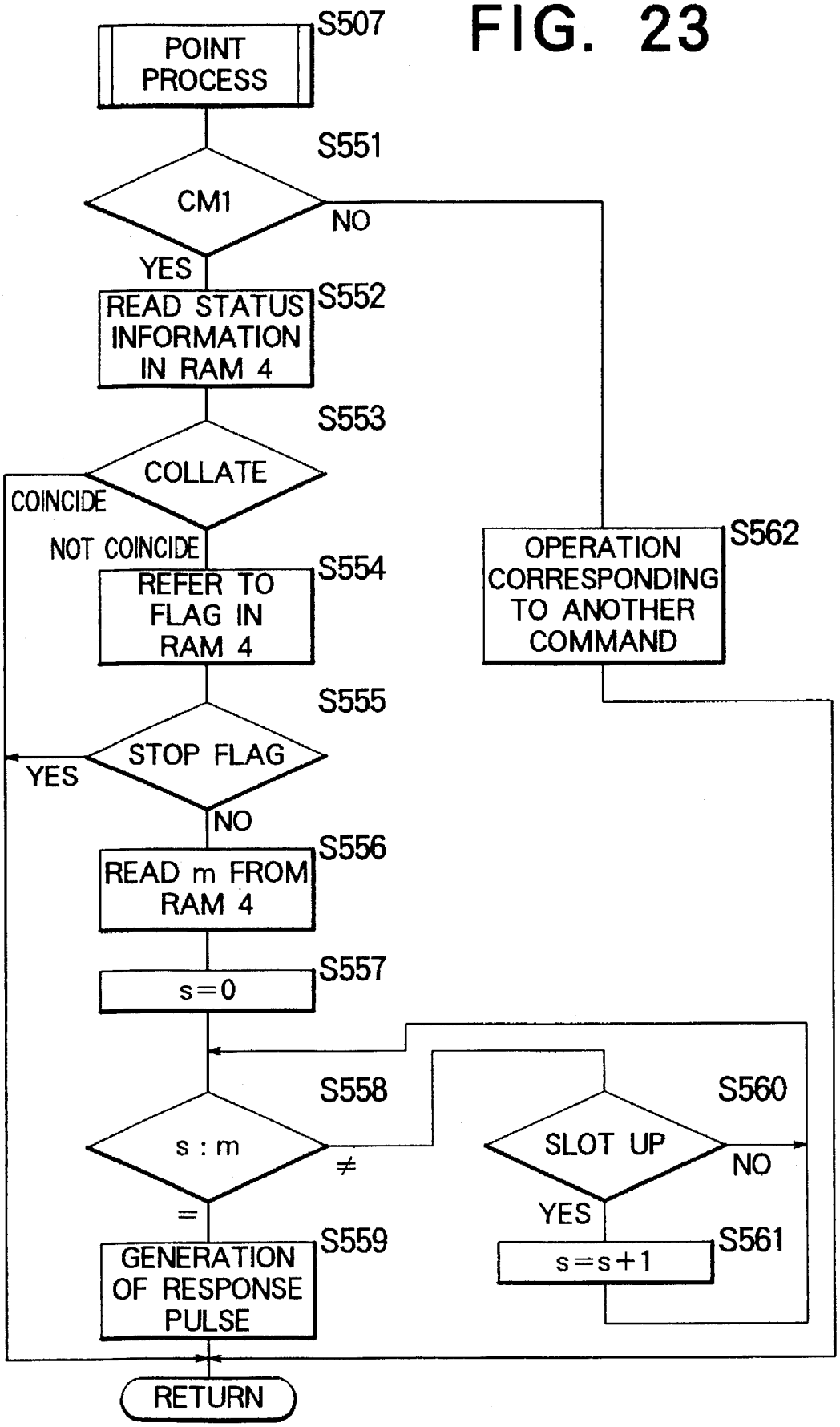
FIG. 23 is a flow chart showing an example of a point process (S507) that is performed by the transmitter P according to the foregoing embodiment.

FIG. 23 is a flow chart showing a specific example of the point process (S507) to be performed by the transmitter P according to the foregoing embodiment.

If the command received from the fire detection unit 40 of the fire receiver RE is the command GAD(g) for the point polling for appointing the group g to which the transmitter P belongs (S506) and as well as the command is the status information return command CM1 that requires the status change information for only the transmitter P (S551), the present status information and the status information that has been transmitted are read from the RAM 4 (S552). If the two status information items do not coincide with each other (S553), it means that the state of the transmitter P has been changed and a reference to the flag in the RAM 34 is made (S554). If no response stop flag is present (S555), it means that the status information in the RAM 4 is information that can be transmitted to the fire detection unit 40 of the fire receiver RE. Therefore, the number m of the transmitter P in the group is read from the RAM 4 (S556) and as well as the slot number s is set to zero (S557).

If the slot number s and the number m in the group coincide with each other (S558), a response pulse is transmitted (S559) to respond to the fire detection unit 40 of the fire receiver RE. If the slot number s and the number m in the group do not coincide with each other (S558), the slot number is increased by one when the response timing to the number s has been completed (S560 and S561) to collate the slot number s and the number g in the group (S558). If the command received from the fire detection unit 40 of the fire receiver RE is not the status information return command CM1 for transmitting the status change (S551) but it is another command, a process corresponding to the command is performed (S562).

Also in the point process (S507), response to the status information return command CM2 for requiring the normal status change information is permitted similarly to the system process (S503) as well as the response to the status information return command CM1 for requiring the status change information for only the transmitter P.

Figure 24:
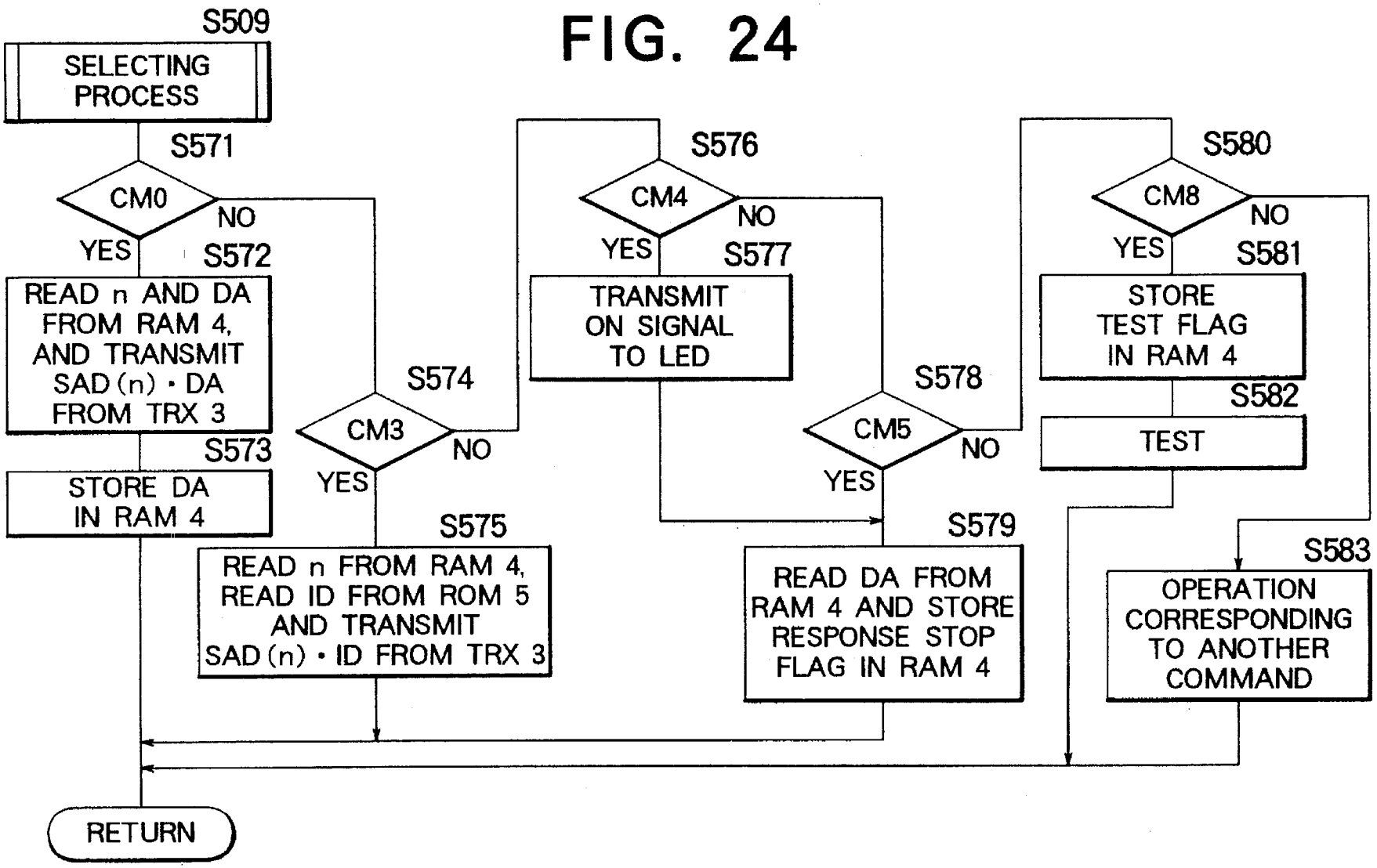
FIG. 24 is a flow chart showing an example of a selecting process (S509) that is performed by the transmitter P according to the foregoing embodiment.

FIG. 24 is a flow chart showing a specific example of the selecting process (S509) to be performed by the transmitter P according to the foregoing embodiment.

If the command received from the fire detection unit 40 of the fire receiver RE is the selecting command SAD(n) for appointing the address n of the transmitter P (S508) and as well as it is the status information return command CM0 in the selecting (S571), the address n of the terminal unit and data DA denoting the present status information are read from the RAM 4, command SAD(n)·DA denoting the status change of the transmitter P is transmitted from the signal transmitting/receiving portion TRX 3 (S572), and data DA that has been transmitted is stored in the RAM 4 (S573). If the command received from the fire detection unit 40 of the fire receiver RE is not the status information return command CM0 but it is the command CM3 (that is, the disconnection discrimination selecting) for requiring the type information (S571 and S574), the address n of the terminal unit is read from the RAM 4, the type information ID of the transmitter P is read from the ROM 5, and the command SAD(n)·ID denoting the type information is transmitted from the signal transmitting/receiving portion TRX 3 (S575).

If the command received from the fire detection unit 40 of the fire receiver RE is the fire determined command CM4 (S576), a turning on signal is transmitted to the response lamp LED to turn on it (S577). Furthermore, the fire determined flag for inhibiting the response to the system polling and the point polling in accordance with the ensuing status information is stored in the RAM 4 (S879). If the command received from the fire detection unit 40 of the fire receiver RE is the remote test command CM8 (S580), the test flag is stored in the RAM 4 (S581), and the test process is performed (S582). If the command is another command, a process corresponding to the command is performed (S583).

Figure 25:
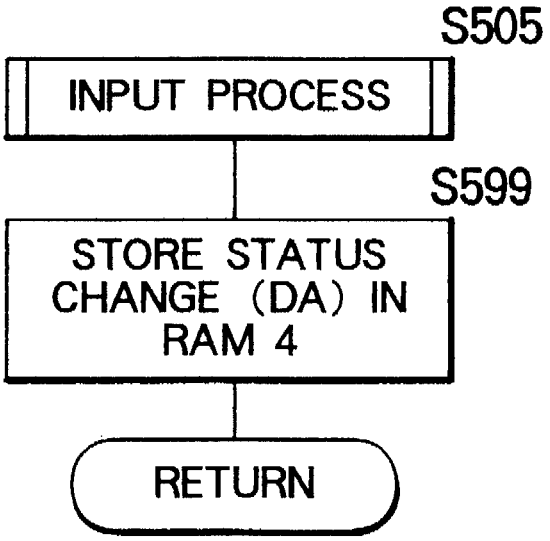
FIG. 25 is a flow chart showing an example of an input process (S505) that is performed by the transmitter P according to the foregoing embodiment.

FIG. 25 is a flow chart showing a specific example of the input process (S505) to be performed by the transmitter P according to the foregoing embodiment.

If a person who has detected the fire depresses the push-button switch SW provided for the transmitter P, a switch input is made from the switch SW (S504). At this time, data DA denoting the operation of the switch SW is stored in the RAM 4 (S599) and the operation is returned.

Figure 26:
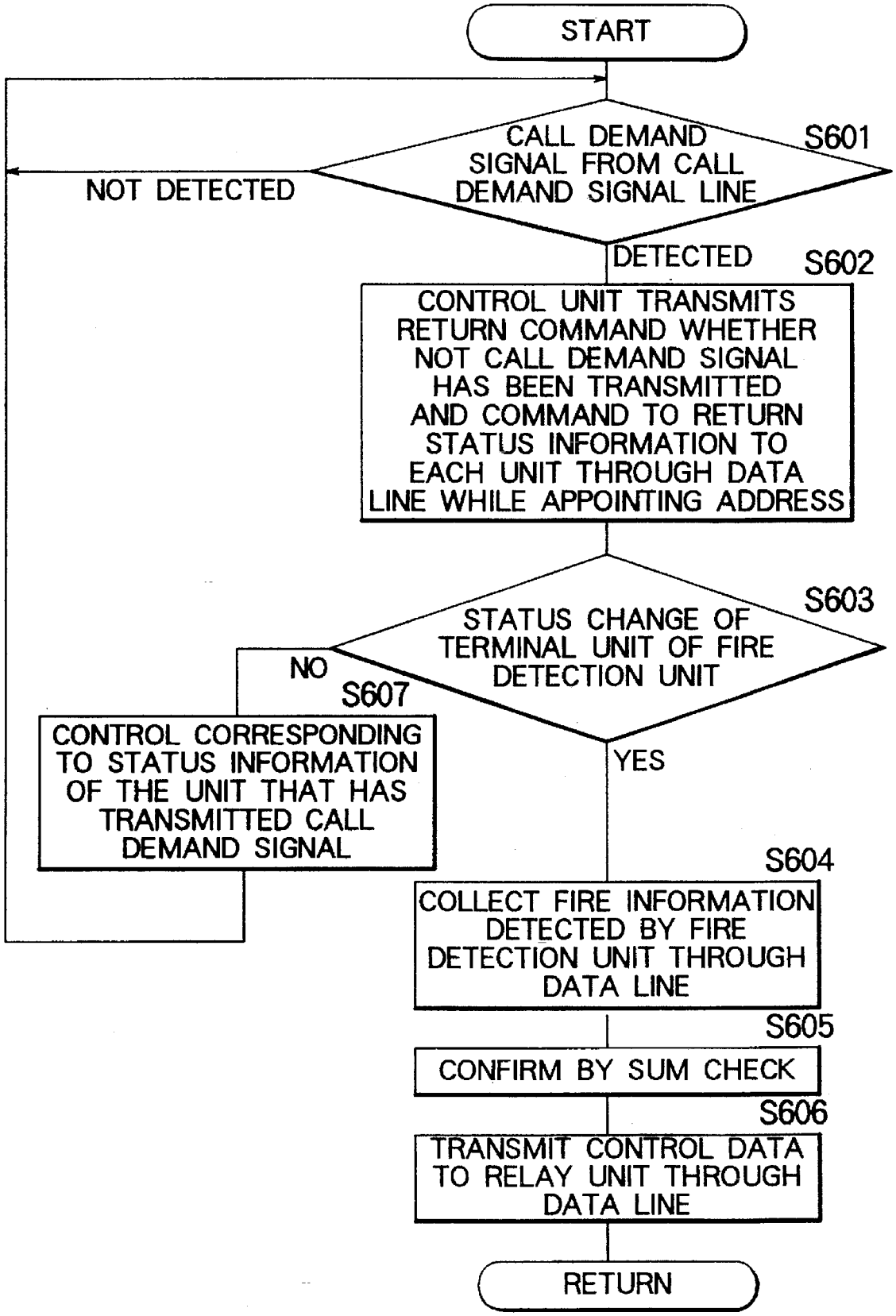
FIG. 26 is a time chart showing the operation relating to a call demand signal among the operations to be performed by a control unit 10 in the fire receiver according to the foregoing embodiment.

FIG. 26 is a time chart showing the operation relating to the call demand signal among the operations of the control unit 10 in the fire receiver according to the foregoing embodiment.

In a normal state, the control unit 10 sequentially and circularly calls the power supply unit 20, display/control unit 30, the fire detection unit 40 and the relay units 50, 60 and 70 through the data line DL in accordance with the address given to each unit so that control, such as transmission/receipt of each information, is performed.

An assumption is made that the fire detection unit 40 performs polling with the terminal units as described above and a certain detector S has detected a fire. The MPU 41 of the fire detection unit 40, at this time, transmits to the control unit 10 the call demand signal through the call demand signal line CL. The control unit 10 detects the call signal (S601). The control unit 10 immediately and sequentially appoints the addresses through the data line DL to cause each unit to transmit a return command denoting whether or not each unit has transmitted the call demand signal (S602). That is, the control unit 10 initially transmits, for example, the address of the power supply unit 20 and the status information return command to the data line DL; waits for return of the status information from the power supply unit 20; receives the status information transmitted from the power supply unit 20; and performs the foregoing operations of transmitting the address and the status information return command and receiving the status information with respect to each of the display/control unit 30, the fire detection unit 40 and relay units 50, 60 and 70.

Figure 27:
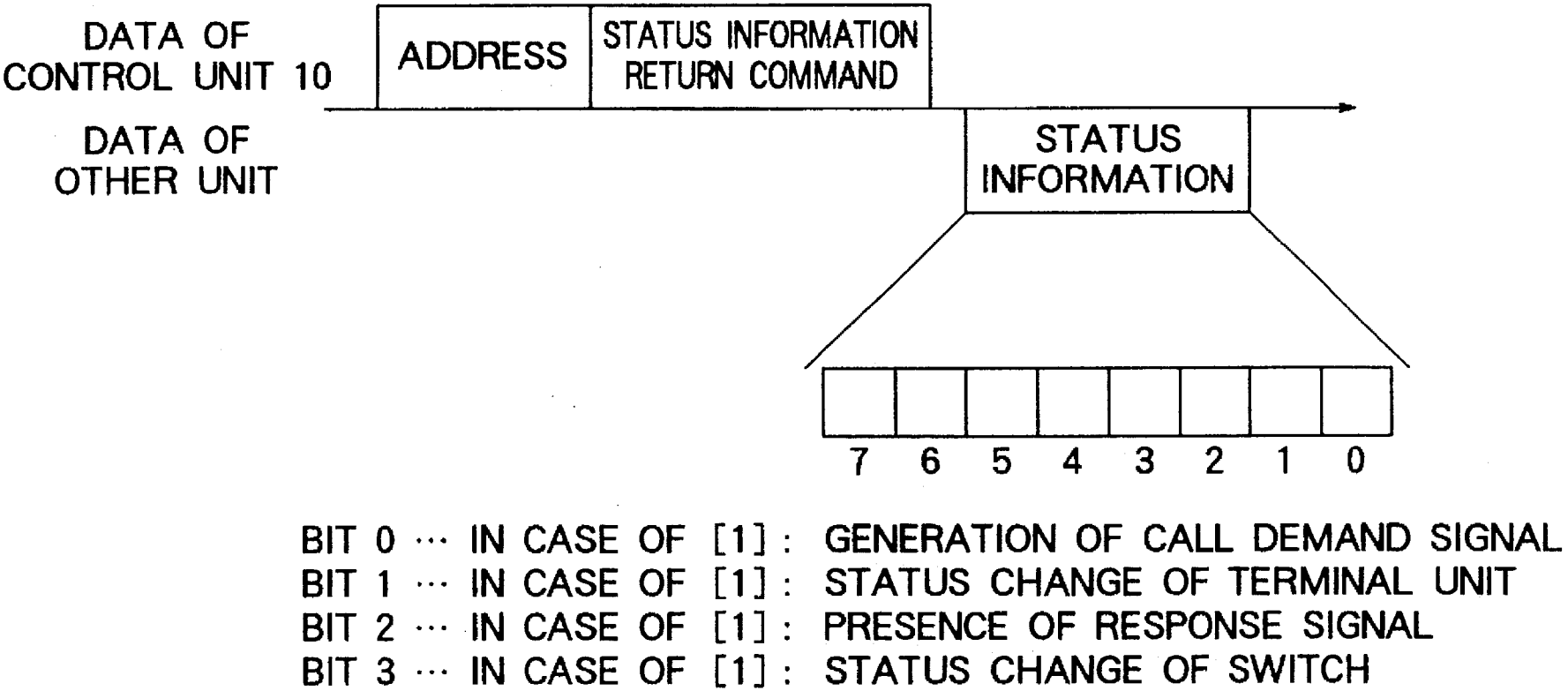
FIG. 27 illustrates a case where the control unit 10 transmits each address and a status information return command to each unit after the control unit 10 has received the call demand signal.

FIG. 27 illustrates the operation where the control unit 10 transmits, to each unit, each address and the status information return command after it has received the call demand signal.

As shown in FIG. 27, in a case where the unit that has received the status information return command has transmitted the call demand signal, bit 0 of the status information to be return to the control unit 10 is set to "1". In a case where the fire detection unit 40 returns the status information, bit 1 is set to "1" if a terminal unit connected to the fire detection unit 40 has a status change.

In a case where the control unit 10 discriminates that the fire detection unit 40 has transmitted the call demand signal and it detects that the status of a terminal unit of the fire detection unit 40, for example, a fire detection unit 40, has been changed (S603), the control unit 10 collects fire information detected by the fire detection unit 40 through the data line data line DL (S604). That is, the control unit transmits the fire information return command to the fire detection unit 40 through the data line data line DL. In response to the foregoing command, the fire detection unit 40 transmits the fire information and its sum check code to the control unit 10 through the data line data line DL. The control unit 10 confirms that the fire information has been received in accordance with the sum check (S605), and it transmits control data to the relay units 50, 60 and 70 through the data lines DL in order to cause the relay corresponding to the fire information to be operated (S606).

If a fact that a unit except the fire detection unit 40 has transmitted the call demand signal is detected as a result of an operation performed by the control unit 10 for inspecting a unit that has transmitted the call demand signal (S603), the control unit 10 performs control corresponding to the status information of the unit that has transmitted the call demand signal (S607). In the foregoing case, the communication between the unit except the fire detection unit 40 and the control unit is performed through the data line DL, thus resulting in that the call demand signal line CL is in an idle state.

If the call demand signal is, during the foregoing operation, transmitted when the fire detection unit 40 has detected a fire, the fire detection unit 40 is able to communicate with the control unit 10 while being given priority even in a period the control unit 10 is communicating with another unit or a period the control unit 10 performs an operation except the communication with the other unit (the fire detection unit 40 is enabled to demand the control unit 10 to call the unit through the idle call demand signal line CL and the foregoing call demand is given priority). Therefore, the fire information can quickly be transmitted to the control unit 10. Even if a large number of units are controlled by the control unit 10, the fire information can quickly be transmitted to the control unit 10.

Since the data line DL is used only when it is required, no practical problem takes place even if the transmission rate is lowered. By lowering the transmission rate as described above, influence of external noise can be eliminated satisfactorily. That is, lowering of the transmission rate enables the pulse width of the signal to be lengthened. Thus, the signal pulse and noise can easily be distinguished from each other and external noise can be removed by using a high-cut filter. As a result, the influence of external noise can be eliminated satisfactorily.

The necessity of frequently performing the polling operations between the MPU 11 of the control unit 10 and the units 20, 30, 40, 50, 60 and 70 can be eliminated. Thus, the time for performing the polling operations can be shortened. As a result, the MPU 11 is able to perform operations except the polling operations, such as a timer process and a matrix control process. Therefore, a small-function and low-cost MPU can be used to serve as the MPU 11.

Each of the relay units 50, 60 and 70 controls required relays 52, 62 and 72 in accordance with the control data (S606) transmitted from the control unit 10.

Summarily, the terminal units in the controlled system, such as the local bells B, the smoke blocking and exhausting units ER and the display units AN, have no address but they are controlled (connected in a so-called P-connection manner) by turning on/off the signal lines L2, L3 and L4 provided individually for each terminal unit or the system. The MPUs 51, 61 and 71 of each relay unit that has received control data from the control unit 10 operates the relays 52, 62 and 72 in accordance with the contents of the control data to turn on/off required signal lines. Thus, required terminal units in the controlled system are operated.

That is, all local bells B are connected to the two signal lines constituting the local sound connection lines L2 connected to the relay unit 50 for controlling the local sound. All local bells B are collectively rung by connecting/disconnecting the signal lines. The smoke blocking and exhausting connection line L3 connected to the relay unit 60 for controlling the smoke blocking and exhausting units comprises a common line and individual signal lines connected to corresponding smoke blocking and exhausting units ER, that is, comprises (the number of smoke blocking and exhausting units ER+1) signal lines. Each smoke blocking and exhausting unit ER is individually turned on/off. The display unit connection line L4 connected to the relay unit 70 for controlling the display units comprises a plurality of signal lines determined to be capable of displaying the contents. All display units AN are connected among the foregoing signal lines. When a predetermined signal line is turned on/off, a common content is displayed on each display unit. Although the foregoing embodiment employs a method in which the local bells B are simultaneously rung, a method may be employed in which the local bells B are rung in each region such that the sound control is performed for each floor. The necessity of specifying a unit to be connected to each relay unit can be eliminated.

Since the terminal units in the supervisory system are R-connected and the terminal units in the control system are P-connected, the R-lines connected to the terminal units in the supervisory system can be minimized to two. Thus, the wiring space required for the terminal units in the control system can be reduced. In a case of small-size fire alarm system comprising a small number of terminal units in the control system, the number of P-lines connected to the terminal units in the control system can be decreased. Therefore, the wiring space for all terminal units including the terminal units in the supervisor system and those in the control system can be reduced.

Although a relay must be provided in a case where the terminal units in the control system are R-connected in order to perform the transmission control, such as giving of the addresses, the P-connection of the terminal units in the control system enables the relay to be omitted. As a result, the space required for the relay can be used effectively.

In addition to the reduction of the space required for the signal lines and so forth, the fire supervisory can be performed quickly because the supervisory system and the control system uses individual lines and the individual units are used. Furthermore, a process for transmitting command codes and so forth can be performed easily and the load that must be borne by the receiver RE can be reduced. Therefore, the discrimination can easily be made.

Figure 28:
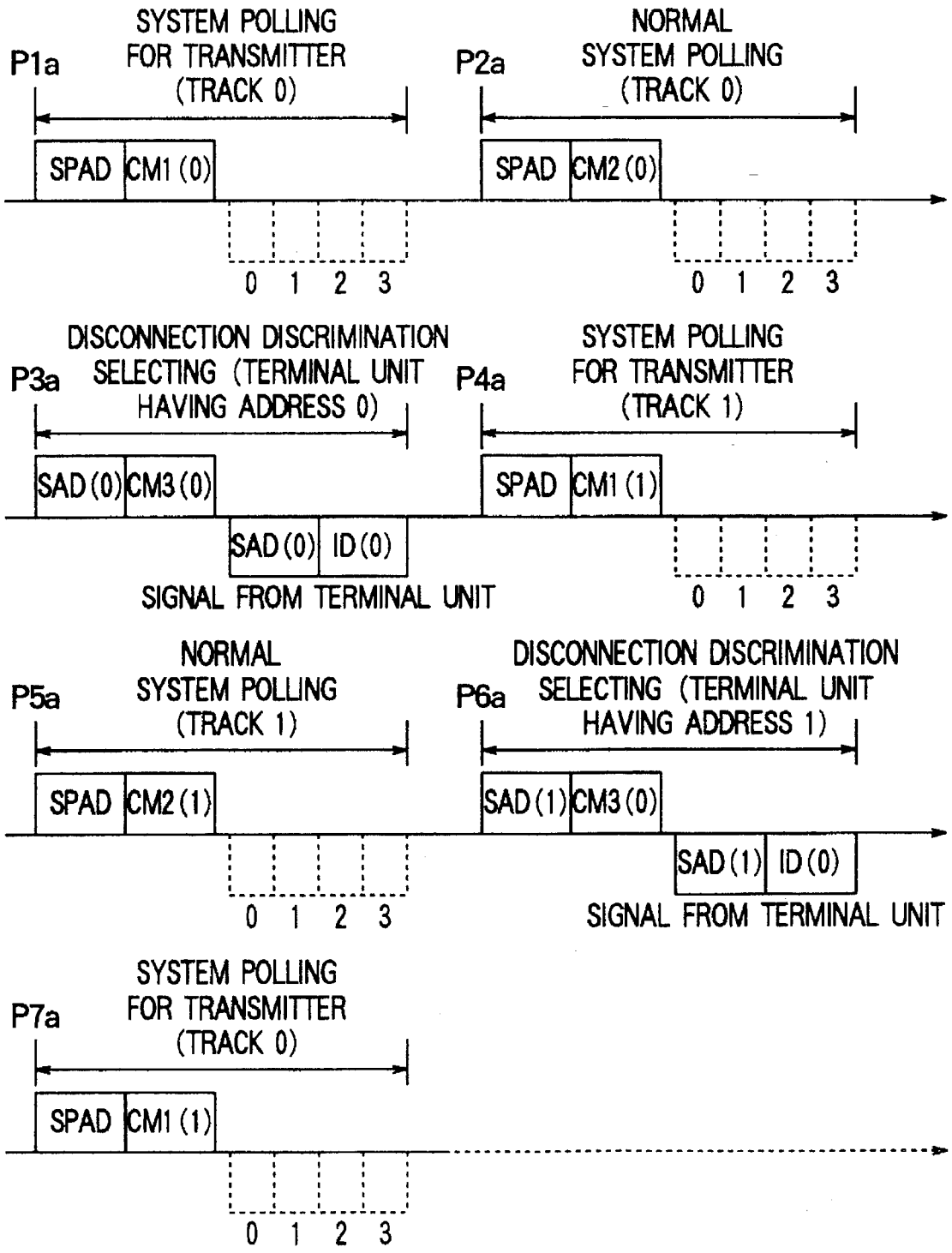
FIG. 28 illustrates a case where a multiplicity of groups are further divided into a plurality of groups in a case where a large number of terminal units are present and system polling is performed by using the tracks.

FIG. 28 illustrates the system polling of a type in which a multiplicity of terminal units groups are divided into a plurality of tracks which are used to perform the system polling.

The embodiment shown in FIG. 28 includes eight terminal unit groups arranged such that first four groups belong to track 0, residual four groups belong to track 1 and four terminal units belong to each group.

At P1*a* shown in FIG. 28, the terminal units belonging to track 0 are subjected to the system polling for a transmitter. A command for the system polling for a transmitter to which only the transmitters belonging to track 0 respond is SPAD·CM1 (0).

The "SPAD" in the command including the foregoing command is composed of, for example 8 bits, while "CM1 (0)" is composed of 8 bits. That is, the structure of the command for appointing the group and the address is appointed with the 8 forward bits of the command and a portion of the following 8 bits of the command is used to appoint the track t. Command CM1 (0) is a status return command for a transmitter that relates to track 0 (note that CM1 is a normal status information return command for a transmitter). CM2 (1) is a normal status information return command that relates to track 1 (note that CM2 is a normal status information return command).

At P2*a*, the terminal units belonging to track 0 are subjected to the normal system polling. The command for the normal system polling for the terminal units belonging to track 0 is SPAD·CM2 (0). Then, terminal units belonging to track 0 are subjected to the disconnection discrimination selecting at P3*a*.

The polling of the transmitters belonging to track 0 and polling of the terminal units belonging to track 0 are completed, and then polling of the transmitter belonging to track 1 and polling of terminal units belonging to track 1 are performed. That is, the transmitter belonging to track 1 is subjected to the system polling for a transmitter at P4*a*. Command for the system polling for a transmitter to which the transmitter belonging to track 1 is subjected is SPAD·CM1 (1). At P5*a*, the terminal units belonging to track 1 are subject to the normal system polling. Command for the normal system polling for a transmitter to which the terminal units belonging to track 1 are subjected is SPAD·CM2 (1). Then, a terminal unit having address 1 is, at P6*a*, subjected to the disconnection discrimination selecting.

After the system polling of the transmitters and the terminal units belonging to tracks 0 and 1 has been completed, the foregoing operation is repeated (the disconnection discrimination selecting is performed by sequentially increasing the address by one). That is, the system polling for a transmitter for track 0 is performed at P7*a* similarly to P1*a*. Then, the normal system polling for the track 0 is performed similarly to P2*a*. Thus, the foregoing operation is repeated.

If the multiplicity of groups of the transmitters and the terminal units are divided into a plurality of tracks to perform the system polling by using the tracks, a great advantage can be obtained in a case where a very large number of transmitters or terminal units are present and only a very small number of address setting regions can be used. That is, one of the plurality of tracks is appointed with a command so that the track is enabled to substantially serve as an address. Thus, the address can be substantially multiplied.

Figure 29:
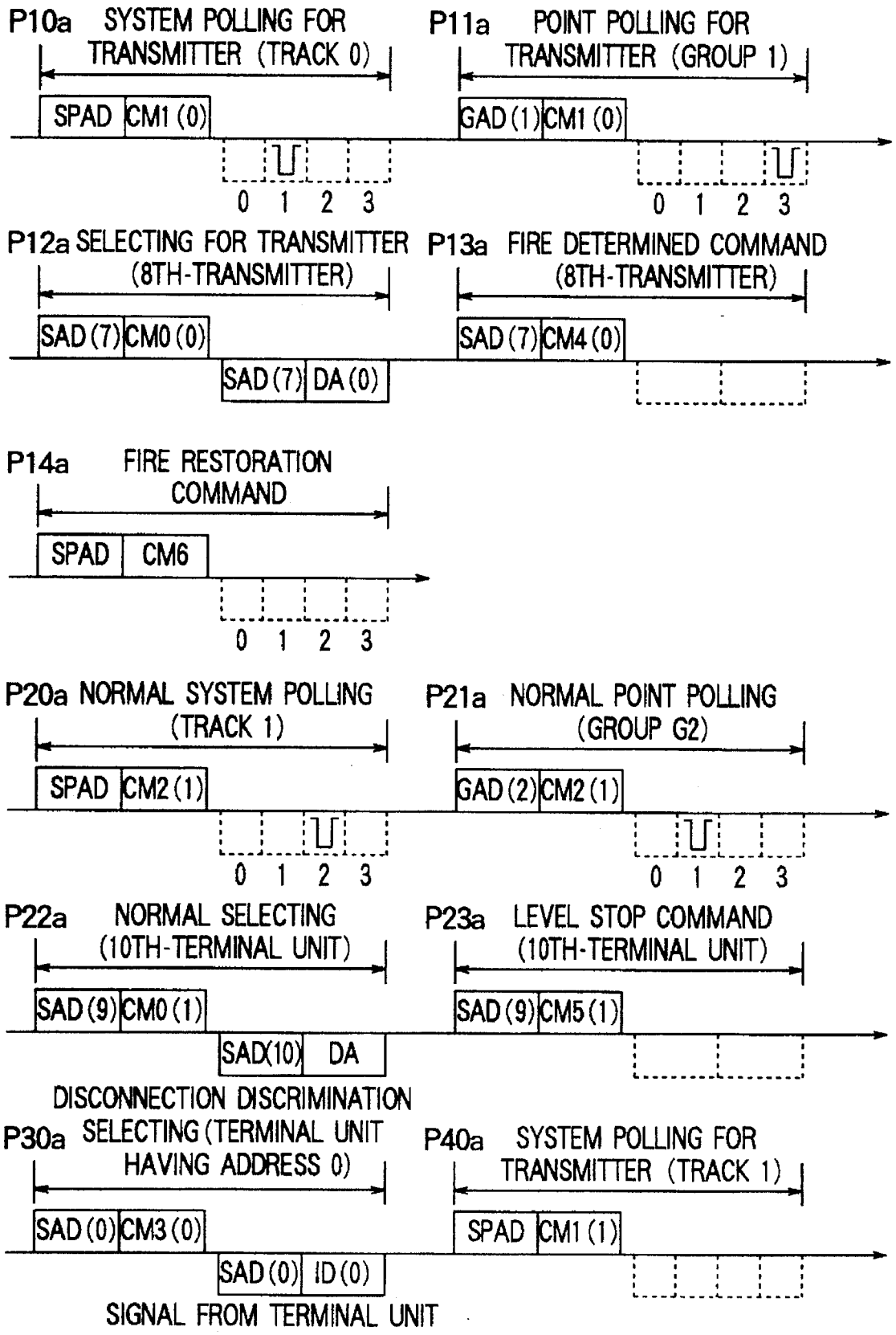
FIG. 29 is a time chart showing the operation to be performed in a case where a transmitter or a terminal unit having a status change is present in the system polling for a transmitter and the normal system polling in the embodiment shown in FIG. 28.

FIG. 29 is a time chart showing the operation to be performed in a case where there are a transmitter and a terminal unit having a changed state in the system polling for a transmitter and the normal system polling according to the embodiment shown in FIG. 28.

If the transmitter responds at the response timing for the group G1 (any of the transmitters belonging to group G1 is depressed) when the code SPAD·CM1 (0) denoting the system polling for a transmitter for track 0 has been transmitted from the fire detection unit 40 of the fire receiver RE at P10*a* shown in FIG. 29, the fire detection unit 40 of the fire receiver RE transmits to the group G1 the code GAD (1)·CM1 (0) denoting the point polling for a transmitter at P11*a*. If a fourth transmitter responds at this time, the fire detection unit 40 of the fire receiver RE transmits to the eighth transmitter (having address 7) the status information return command SAD(7)·CM0 (0) at P12*a*. The eighth transmitter transmits the self-address and the data DA. Thus, the fire detection unit 40 of the fire receiver RE confirms that the eighth transmitter has been operated.

As a result, the fire detection unit 40 of the fire receiver RE transmits to the transmitter that has made a response the fire determined command SAD(7)·CM4 (0) at P13*a*. As a result, response for the eighth transmitter to the fire detection unit 40 of the fire receiver RE is, in the system polling and the point polling, inhibited. Further, the transmitter turns on the response lamp. When the fire detection unit 40 of the fire receiver RE transmits the fire restoration command SPAD·CM6 to all terminal units at P14*a* after the fire extinguishing operation has been performed and thus the fire has been extinguished, the transmitter, to which the fire determined command has been issued, is restored and the response to a novel issue of the alarm is permitted.

When the fire detection unit 40 of the fire receiver RE has transmitted to the terminal units belonging to track 1 the command SPAD·CM2 (1) for performing the normal system polling at P20*a* and the terminal unit responds to it at the response timing for the group G2 (if any of the terminal units belonging to group G2 of the track 1 has a status change), the second terminal unit responds to this when the command GAD(2)·CM2 (1) for performing the normal point polling has been transmitted to the group G2 at P21*a*. Therefore, the command SAD(9)·CM0 (1) denoting the status information return command is transmitted to the thirty-sixth terminal unit (address 9 of track 0 since 16 terminal units belong to one track) at P22*a*. Furthermore, the thirty-sixth terminal unit transmits information DA of the status change. Thus, the fire detection unit 40 of the fire receiver RE is able to confirm the contents of the status change.

An assumption is made that the fire detection unit 40 of the fire receiver RE has transmitted level stop command SAD(9)·CM5 (1) to its terminal unit at P23*a*. It means that the fire level used when the response signal has been transmitted is an unnecessary fire level. Thus, the thirty-sixth terminal unit is then inhibited to transmit the response signal for the foregoing fire level. At P30*a*, the terminal unit having address 0 is subjected to the disconnection discrimination selecting. At P40*a*, the fire detection unit 40 of the fire receiver RE subjects the track 1 to the system polling for a transmitter. Then, the fire detection unit 40 of the fire receiver RE subjects the track 1 to the normal system polling. Then, the foregoing operation is repeated.

Figure 30:
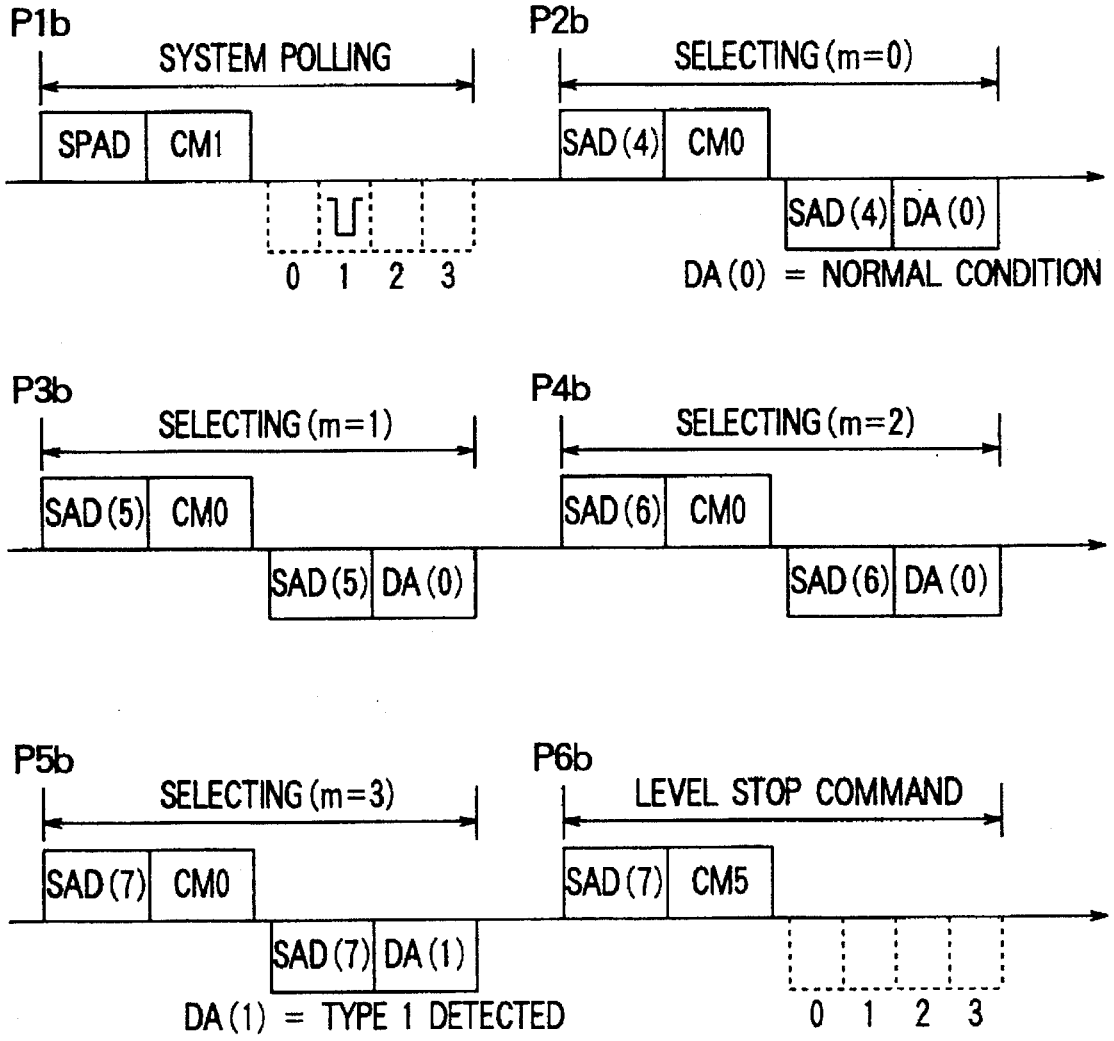
FIG. 30 is a time chart of an operation that, by system polling, specifies one group consisting of a plurality of terminal units and that collects information by selecting each of the terminal units belonging to the specified group.

FIG. 30 is a time chart of a method in which one of groups each of which consists of a plurality of terminal units is specified by the system polling and each of the terminal units belonging to the specified group is subjected to the selecting so as to collect information.

The time chart has a structure that the point polling of the embodiments shown in FIGS. 1 to 27 is omitted and all terminal units belonging to the group that has responded to the system polling are subjected to the selecting P2*b*, P3*b*, P4*b* and P5*b*.

All terminal units belonging to the group, which has responded to the system polling performed at P1*b*, are subjected to the selecting to be performed at P2*b*, P3*b*, P4*b*, P5*b* and P6*b*. Furthermore, the point polling is omitted.

Figure 31:
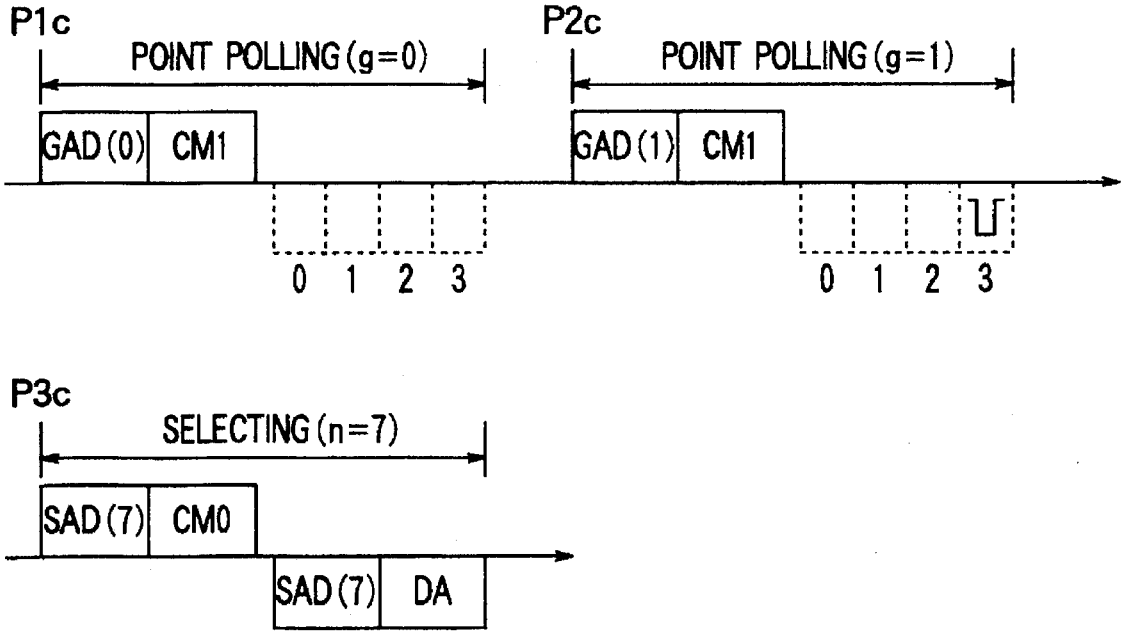
FIG. 31 is a time chart of an operation in which the system polling is omitted, all terminal units are subjected to the point polling, and only the terminal unit that has made a response to the point polling is subjected to the selecting to collect information.

FIG. 31 is a time chart of a method in which the system polling is omitted, all terminal units are subjected to the point polling, and only terminal units that have responded to the point polling are subjected to the selecting so that information is collected.

That is, the time chart shows the operation in which the system polling is omitted, all terminal units are subjected to the point polling as shown in P1*c* and P2*c*, and only the terminal units that have responded to the point polling are subjected to the selecting as shown in P3*c* so that information is collected. The polling to be performed by the fire detection unit 40 is not limited to the system polling, point polling and the selecting. The fire detection unit 40 may perform a conventional method, such as the shake-hand method, in which each terminal is sequentially and circularly called.

Figure 32:
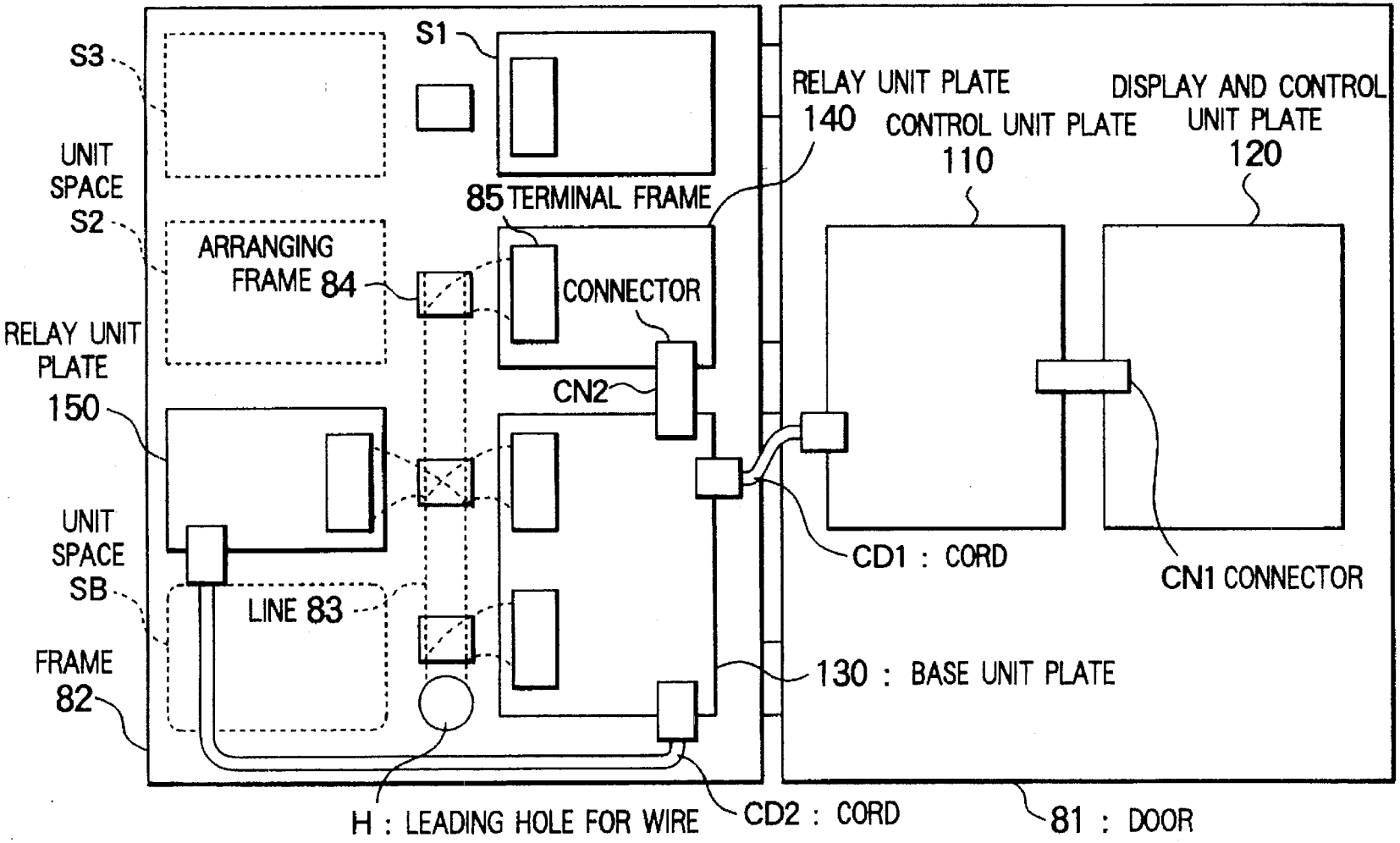
FIG. 32 is a diagram showing the configurations units provided for a door 81 and a base 82 of the fire receiver according to the foregoing embodiment, where the door 81 is opened.

FIG. 32 illustrates the configuration of units provided for a door 81 and a base 82 of the fire receiver according to the foregoing embodiment, where the door 81 is opened.

Referring to FIG. 32, a control unit plate 110 is a printed circuit board on which the control unit 10 is mounted, a display control unit plate 120 is a printed circuit board on which the display/control unit 30 is mounted, a basic unit plate 30 is a printed circuit board on which the power supply unit 20, the fire detection unit 40 and the relay unit 50 are mounted, a relay unit plate 140 is a printed circuit board on which the relay unit 60 is mounted, and a relay unit plate 150 is a printed circuit board on which the relay unit 70 is mounted.

The control unit plate 110 and the display control unit plate 120 are disposed on the door 81 of the frame of the fire receiver. The basic unit plate 130, the relay unit plate 140 and the relay unit plate 150 are disposed on the base 82 of the frame of the fire receiver.

Since three relay units are disposed in the foregoing embodiment, two relay unit plates 140 and 150 are disposed on the base 82. However, only one relay unit is sometimes sufficient to control all units if the system has small size. In order to satisfactorily control the connection/disconnection of the signal lines, one relay unit is mounted on the basic unit plate 130. Thus, additional relay units are disposed in unit spaces S1, S2 and S3 to be adaptable to the size of the subject building or the like so that the system is able to be used from a small subject to a large subject.

A terminal of a signal line in one printed circuit board among the plurality of the printed circuit boards and a terminal of a signal line of another printed circuit board are connected to each other by connectors CN1 and CN2. For example, the terminal of a signal line of the basic unit plate 130 and the terminal of a signal line of the rely unit plate 140 are connected to each other by the connector CN2 so that the two unit plates 130 and 140 are connected to each other. The signal lines connected as described above are signal lines, such as the data line DL or the like according to the foregoing embodiment. In the base unit plate 130, the signal lines are connected to the power supply unit 20, the fire detection unit 40 and the relay unit 50.

Although portions that cannot be connected by the connector use cords CD1 and CD2, the connection can be established basically be a similar operation. Lines 83 are signal lines for establishing the connection with a terminal unit or the like that is connected to each unit. A line collecting frame 84 collects lines 83, while a terminal frame 85 is a frame provided for each unit plate for the purpose of connecting the line 83 to each unit plate. Although space SB is omitted from illustration, a sub-power-source or the like is disposed in the space SB.

Although the data line DL and the call demand signal line CL according to the foregoing embodiment are adapted to serial transmission, the data line DL and/or the call demand signal line CL may be adapted to parallel transmission. If the parallel transmission is employed, the clock line CK may be omitted. If data is transmitted in a non-synchronous manner by serial transmission, the clock line CK may be omitted.

In each of the foregoing embodiments, the system polling for a transmitter is performed so that the receiving portion is able to quickly recognize the type information when a terminal unit, such as a transmitter, given priority has been operated. Thus, the fire information of the transmitter can be quickly recognized by the receiving portion. Therefore, the system polling, in which a plurality of variable terminal units, such as a plurality of transmitters, a plurality of fire detectors and a plurality of smoke blocking and exhausting units having addresses and connected to the receiving portion are divided into a plurality of groups and the group to which a terminal unit having a changed status belongs is detected in accordance with the response timing, is arranged in such a manner that the system polling for a specific terminal unit is performed prior to the normal system polling. The system polling for a specific terminal unit is polling to which a specific type terminal unit responds, such as only the transmitter, only the transmitter and the fire detector (only units that supervises fire). A point polling in which the terminal unit having a changed status in a group that has responded to the system polling is specified in accordance with the response timing is arranged in such a manner that the system polling for a specific terminal unit to which only the specified type terminal unit responds is performed prior to the normal point polling. As an alternative to this, the foregoing methods are performed while being combined so that fire information of a terminal unit, such as the transmitter, of a type to be recognized immediately is enabled to be quickly recognized by the receiving portion even if a large number of terminal units are present.

Since each of the foregoing embodiments has the arrangement that the fire determined command for stopping response to the receiving portion is, after the operation of the terminal unit has been determined, transmitted from the receiving portion to the terminal unit, the operation of which has been determined. Therefore, even if the detection level is repeatedly raised or lowered in the vicinity of the fire discrimination level, the frequent response of the terminal unit to the receiving portion can be prevented. Therefore, the receiving portion does not collect needless information and information of a terminal unit that is operated newly can quickly be collected.

When the system polling, the point polling and the selecting are performed, the fire determined command transmitting means (the means for transmitting the fire determined command for causing the terminal unit among the terminal units, the operation of which has been determined, to stop response to the receiving portion) is used. As an alternative to this, another method may be employed in which the fire determined command transmitting means is used in a case where the selecting for collecting a predetermined information from a terminal unit in a group to which the terminal unit that has responded to the receiving portion in the system polling belongs and system polling are performed and the point polling is not performed. The fire determined command transmitting means may be used in a case where the point polling and the selecting are performed and the system polling is not performed.

Each of the foregoing embodiments has the arrangement that the receiving portion transmits to the fire detector the level stop command when the fire information received from the multi-signal-type fire detector by the receiving portion is not a desired fire discrimination level. Therefore, the receiving portion does not further collect signals of unnecessary levels from the multi-signal-type fire detector. Thus, non-required response to the receiving portion can be decreased. That is, the fire receiver has a level stop means for transmitting the level stop command for stopping unnecessary levels. The fire detector has a level stop means for stopping response of the level that is the subject of the supplied level stop command.

The level stop means of the fire detector is a means which reads the reference level from a predetermined storage means when it receives the level stop command from the receiving portion, which subjects the detected level and the read reference level to a comparison and which inhibits response to the receiving portion that the status change has taken place if a discrimination has been made that the detected level is higher than the reference level. As an alternative to this, a means may be used which inhibits the operation of reading the reference level from the predetermined storage means when the level stop command has been received from the receiving portion. Also the foregoing structure enables the operation that are the same as the foregoing operation for inhibiting the response that the status change has taken place to be performed as for the reference level, the reading of which has been stopped.

In a case where a discrimination is made as a result of the discrimination made by the receiving portion that the level is an unnecessary level, the receipt of the fire information about the unnecessary level from the multi-signal-type fire detector enables the discrimination to be made that the level received by the receiving portion is the unnecessary level. Therefore, storage of the fire detector, the level of which has been stopped, by the fire receiver enables that the line about the detector that has made a response was free from disconnection can be confirmed afterwards.

The fire detector may comprise a detection means that detects the environmental change occurring due to a fire phenomenon to transmit the sensor level, a fire discriminating means that subjects the sensor level transmitted from the detection means and a plurality of different levels to a comparison to discriminate fire, a response means for responding the status change, which is the result of the discrimination made by the discriminating means, to the receiving portion at the time of polling made from the receiving portion, and a level stop means which is address-appointed by the receiving portion to receive the level stop command and which stops the response about the level appointed by the received level stop command.

Each of the foregoing embodiments has the arrangement that the system polling is performed in such a manner that the group is divided into a plurality of tracks, information for identifying the tracks is stored in the command and the system polling is performed for each track. Therefore, even if the number of the terminal units that must be disposed is larger than the number of the terminal units corresponding to the addresses for one track, the address length is the same. That is, the number of the terminal units that can be disposed can be increased without lengthening the address length than a predetermined length.

In usual, the microprocessor processes information in units of four bits or eight bits. In a case where 8 bits are used as the address, increase in the number of the terminal units causes the address to be, for example, 9 bits which are incomplete number for the microprocessor. Thus, the process to be performed by the microprocessor becomes difficult. However, the present invention is able to eliminate the necessity of lengthening the address length than a predetermined length. Therefore, the foregoing difficulty for the microprocessor to complete the process can be eliminated.

In the case where the system polling and the selecting are performed and the point polling is not performed, the plural groups for the system polling may be divided into a plurality of tracks and the system polling may be performed for each track. In the case where the point polling and the selecting are performed and the system polling is not performed, the plural terminal units may be divided into a plurality of tracks and the point polling may be performed for each track.

In the foregoing embodiments, the plural groups consisting of the terminal units (the system polling for a specific terminal unit, the normal system polling, the point polling for a specific terminal unit and the normal point polling) are divided into a plurality of tracks and each track has the number t. As an alternative to this, only the groups consisting of specific terminal units, such as the transmitters, may be divided into a plurality of tracks and the number t may be given to each track. Only the groups consisting of terminal units that do not include the specific terminal unit, may be divided into a plurality of tracks and the number t may be stored for each track.

In the foregoing embodiments, the group that has responded to the system polling is subjected to the point polling to specify the terminal unit and information is collected by the selecting. The normal point polling may be omitted and all terminal units in the group that has responded in the normal system polling may be sequentially and circularly subjected to the selecting. The normal system polling may be omitted and the respective groups may be sequentially and circularly subjected to the point polling to subject the terminal unit having a changed status to the selecting. The point polling for a specific terminal unit may be omitted and all specific terminal units in the group that has made a response in the system polling for a specific terminal unit may be sequentially and circularly subjected to the selecting. The system polling for a specific terminal unit may be omitted and the respective groups may be sequentially and circularly subjected to the point polling for a specific terminal unit to subject the specific terminal unit having a changed status to the selecting. Also in the foregoing case, the receiving portion is able to quickly recognize the fact that the transmitter was depressed. Furthermore, the foregoing level stop and the fire determination may be adapted to the foregoing case.

The terminal unit or the specific terminal unit may be specified by the combination of the normal system polling, the normal point polling, the selecting and the point polling for a specific terminal unit (that is, the system polling for a specific terminal unit may be omitted). The terminal unit or the specific terminal unit may be specified by the combination of the normal system polling, system polling for a specific terminal unit, the normal point polling and the selecting. Also in the foregoing case, the receiving portion is able to quickly recognize the fact that the transmitter was depressed. Furthermore, the foregoing level stop and the fire determination may be adapted to the foregoing case. The normal point polling in the case where the terminal unit or the specific terminal unit is specified by the combination of the normal system polling, the system polling for a specific terminal unit, the normal point polling and the selecting is polling in which the timings at which the terminal unit in a group to which the terminal unit that has responded to the receiving portion in the normal system polling or the system polling for a specific terminal unit responds to the receiving portion is made to be different among the terminal units and the terminal unit having a changed status responds to the receiving portion at the timing at which the terminal unit makes a response.

According to the present invention, a fire alarm system having terminal units in the supervisory system for supervising a fire phenomenon, a receiver and terminal units in a system to be controlled by the receiver and adaptable to a small size system can be constituted by a small number of P-connection lines connected to the terminal units to be controlled. Therefore, effects can be obtained in that: the space required for the lines can be reduced; the relay required in a case where the terminal units to be controlled are R-connected can be omitted; and the space for the relay can be used effectively.

What is claimed is:

1. A fire alarm system comprising:

a receiver;

a supervisory system including a plurality of first terminal units having different preassigned addresses for effecting fire phenomenon supervision of a supervised area;

a first signal line connected between said plurality of first terminal units and said receiver;

a controlled system including a plurality of second terminal units each including at least one operative device; and, plurality of second signal lines provided in one-to-one correspondence with said plurality of second terminal units and connected between said receiver and said plurality of second terminal units, respectively, wherein said receiver includes a fire detection unit for selectively addressing each of said first terminal units of said supervisory system over said first signal line and a control unit for selectively controlling said at least one operative device of each of said plurality of second terminal units of said controlled system over said plurality of second signal lines, respectively;

wherein said receiver comprises:

means for operating in a normal system polling mode in which said plurality of first terminal units are divided into a plurality of groups and in which each of said groups is assigned a different response timing to respond to said receiver, wherein a first terminal unit having a changed status responds to said receiver at said response timing for a group containing said first terminal unit having the changed status;

means for operating in a normal point polling mode in which each of the first terminal units contained in said group having said first terminal unit having the changed status is assigned a different response timing to respond to said receiver, wherein said first terminal unit having the changed status responds to said receiver at a response timing assigned to said first terminal unit;

means for operating in a specific system polling mode in which only specific terminal units among said first terminal units are divided into a plurality of groups, and in which for each group is assigned a different response timing to respond to said receiver, wherein a specific terminal unit having a status change responds to said receiver at said response timing assigned to a group containing said specific terminal unit having the status change;

means for operating in a point polling in which each of the specific terminal units contained in the group having said specific terminal unit having the status change is assigned a different response timing to respond to said receiver, wherein only said specific terminal unit having the changed status responds to said receiver at said response timing assigned to said specific terminal unit; and selecting means which selects said first terminal unit in said supervisory system that has responded to said receiver during said normal point polling mode and said point polling mode and which causes said receiver to collect a predetermined information from said first terminal unit, wherein a one of said specific terminal system polling mode and said point polling mode are performed prior to performing said normal system polling mode.

2. A fire alarm system comprising:

a receiver;

a supervisory system including a plurality of first terminal units having different preassigned addresses for effecting fire phenomenon supervision of a supervised area;

a first signal line connected between said plurality of first terminal units and said receiver;

a controlled system including a plurality of second terminal units each including at least one operative device; and, plurality of second signal lines provided in one-to-one correspondence with said plurality of second terminal units and connected between said receiver and said plurality of second terminal units, respectively, wherein said receiver includes a fire detection unit for selectively addressing each of said first terminal units of said supervisory system over said first signal line and a control unit for selectively controlling said at least one operative device of each of said plurality of second terminal units of said controlled system over said plurality of second signal lines, respectively;

wherein said receiver comprises:

means for operating in a system polling mode in which said plurality of first terminal units are divided into a plurality of groups, and in which each of said groups is assigned a different response timing to respond to said receiver, wherein a first terminal unit having a changed status responds to said receiver at said response timing assigned to a group containing said first terminal unit having the changed status;

means for operating in a point polling mode in which each of the first terminal units contained in said group having said first terminal unit having the changed status is assigned a different response timing to respond to said receiver, wherein said first terminal unit in said supervisory system having the status change responds to said receiver at a response timing assigned to said first terminal unit;

selecting means for causing said receiver to collect predetermined information from said first terminal unit that has responded to said receiving portion during said point polling mode; and fire determined command transmission means for transmitting a fire determined command to said first terminal unit, the operation of which has been determined, to stop a response of said first terminal unit to said receiver.

3. A fire alarm system comprising:

a receiver;

a supervisory system including a plurality of first terminal units having different preassigned addresses for effecting fire phenomenon supervision of a supervised area;

a first signal line connected between said plurality of first terminal units and said receiver;

a controlled system including a plurality of second terminal units each including at least one operative device; and, plurality of second signal lines provided in one-to-one correspondence with said plurality of second terminal units and connected between said receiver and said plurality of second terminal units, respectively, wherein said receiver includes a fire detection unit for selectively addressing each of said first terminal units of said supervisory system over said first signal line and a control unit for selectively controlling said at least one operative device of each of said plurality of second terminal units of said controlled system over said plurality of second signal lines, respectively;

wherein said first terminal units are fire detectors and wherein said receiver comprises:

means for operating in a system polling mode in which said plurality of fire detectors are divided into a plurality of groups, and in which each of said groups is assigned a different response timing to respond to said receiver, wherein a fire detector having a changed status responds to said receiver at said response timing assigned to a group containing said fire detector having the changed status;

means for operating in a point polling mode in which each of the fire detector contained in said group having said fire detector having the changed status is assigned a different response timing to respond to said receiver, wherein said fire detector in said supervisory system having the status change responds to said receiver at a response timing assigned to said fire detector;

selecting means for causing said receiver to collect predetermined information from said fire detector that has responded to said receiving portion during said point polling mode; and level discrimination means for discriminating a signal level received from said fire detector; and level stop command transmitting means for transmitting a level stop command for causing said fire detector to stop response at said received level if said received signal is not a desired signal level;

wherein said fire detector that has received said level stop command does not make a response at said level, the response of which has been stopped.

4. A fire alarm system comprising:

a receiver;

a supervisory system including a plurality of first terminal units having different preassigned addresses for effecting fire phenomenon supervision of a supervised area;

a first signal line connected between said plurality of first terminal units and said receiver;

a controlled system including a plurality of second terminal units each including at least one operative device; and, plurality of second signal lines provided in one-to-one correspondence with said plurality of second terminal units and connected between said receiver and said plurality of second terminal units, respectively, wherein said receiver includes a fire detection unit for selectively addressing each of said first terminal units of said supervisory system over said first signal line and a control unit for selectively controlling said at least one operative device of each of said plurality of second terminal units of said controlled system over said plurality of second signal lines, respectively;

wherein said receiver comprises:

means for operating in a system polling mode in which said plurality of first terminal units are divided into a plurality of groups, and in which each of said groups is assigned a different response timing to respond to said receiver, wherein a first terminal unit having a changed status responds to said receiver at said response timing assigned to a group containing said first terminal unit having the changed status;

means for operating in a point polling mode in which each of the first terminal units contained in said group having said first terminal unit having the changed status is assigned a different response timing to respond to said receiver, wherein said first terminal unit in said supervisory system having the status change responds to said receiver at a response timing assigned to said first terminal unit;

selecting means for causing said receiver to collect predetermined information from said first terminal unit that has responded to said receiving portion during said point polling mode; and wherein said plurality of groups are divided into a plurality of tracks and said system polling mode is performed for each track.

5. A fire alarm system as claimed in claim 1, wherein said first terminal units are at least one of fire detectors, fire relays and fire transmitters, and wherein said operative devices of said second terminal units are at least one of local sounding devices, fire block doors, smoke blocking dampers and display devices.

6. A fire alarm system as claimed in claim 2, wherein said first terminal units are at least one of fire detectors, fire relays and fire transmitters, and wherein said operative devices of said second terminal units are at least one of local sounding devices, fire block doors, smoke blocking dampers and display devices.

7. A fire alarm system as claimed in claim 3, wherein said first terminal units are at least one of fire detectors, fire relays and fire transmitters, and wherein said operative devices of said second terminal units are at least one of local sounding devices, fire block doors, smoke blocking dampers and display devices.

8. A fire alarm system as claimed in claim 4, wherein said first terminal units are at least one of fire detectors, fire relays and fire transmitters, and wherein said operative devices of said second terminal units are at least one of local sounding devices, fire block doors, smoke blocking dampers and display devices.

9. A fire alarm system as claimed in claim 1, wherein said receiver further includes a power source unit, a display unit and a plurality of relay circuits respectively coupled between said control unit and said plurality of second signal lines, and wherein said power source unit, said fire detection unit and said relay circuits are disposed on a base of a frame accommodating said receiver, and wherein said control unit and said display unit are disposed on a door of said frame.

10. A fire alarm system as claimed in claim 2, wherein said receiver further includes a power source unit, a display unit and a plurality of relay circuits respectively coupled between said control unit and said plurality of second signal lines, and wherein said power source unit, said fire detection unit and said relay circuits are disposed on a base of a frame accommodating said receiver, and wherein said control unit and said display unit are disposed on a door of said frame.

11. A fire alarm system as claimed in claim 3, wherein said receiver further includes a power source unit, a display unit and a plurality of relay circuits respectively coupled between said control unit and said plurality of second signal lines, and wherein said power source unit, said fire detection unit and said relay circuits are disposed on a base of a frame accommodating said receiver, and wherein said control unit and said display unit are disposed on a door of said frame.

12. A fire alarm system as claimed in claim 4, wherein said receiver further includes a power source unit, a display unit and a plurality of relay circuits respectively coupled between said control unit and said plurality of second signal lines, and wherein said power source unit, said fire detection unit and said relay circuits are disposed on a base of a frame accommodating said receiver, and wherein said control unit and said display unit are disposed on a door of said frame.

* * * * *